US011986036B2

(12) United States Patent
Doubt

(10) Patent No.: US 11,986,036 B2
(45) Date of Patent: May 21, 2024

(54) SYSTEM AND METHOD OF SUPPLEMENTING HUMAN HAIR VOLUME

(71) Applicant: Ruxton C. Doubt, Kent, WA (US)

(72) Inventor: Ruxton C. Doubt, Kent, WA (US)

(73) Assignee: Ruxton C. Doubt, Kent, WA (US)

( * ) Notice: Subject to any disclaimer, the term of this patent is extended or adjusted under 35 U.S.C. 154(b) by 517 days.

(21) Appl. No.: 17/055,492

(22) PCT Filed: May 10, 2019

(86) PCT No.: PCT/US2019/031790
§ 371 (c)(1),
(2) Date: Nov. 13, 2020

(87) PCT Pub. No.: WO2019/222054
PCT Pub. Date: Nov. 21, 2019

(65) Prior Publication Data

US 2021/0219643 A1 Jul. 22, 2021

Related U.S. Application Data

(60) Provisional application No. 62/672,415, filed on May 16, 2018.

(51) Int. Cl.
*A41G 5/00* (2006.01)

(52) U.S. Cl.
CPC ..... *A41G 5/008* (2013.01); *A41G 5/0066* (2013.01); *A41G 5/0086* (2013.01)

(58) Field of Classification Search
CPC ..... A41G 5/0053; A41G 5/06; A41G 5/0066; A41G 5/008; A41G 5/0086
See application file for complete search history.

(56) References Cited

U.S. PATENT DOCUMENTS

| | | | |
|---|---|---|---|
| 2005/0236007 | A1 | 10/2005 | Tokko |
| 2016/0000165 | A1 | 1/2016 | Doubt |
| 2016/0345648 | A1 | 12/2016 | Miniello et al. |

FOREIGN PATENT DOCUMENTS

| | | | | |
|---|---|---|---|---|
| GB | 2482131 | A | * | 1/2012 |
| KR | 10-2016-0022198 | A | | 2/2016 |
| WO | 2017/180370 | A1 | | 10/2017 |

* cited by examiner

*Primary Examiner* — Rachel R Steitz
(74) *Attorney, Agent, or Firm* — Seed IP Law Group LLP

(57) ABSTRACT

The present disclosure is directed to systems and methods for supplementing human hair. A system and method includes a wire coupled to an existing hair, wherein the wire pulls the existing hair through a funnel and microtube. A sleeve with supplemental hairs is positioned on the microtube and configured to be coupled to the existing hair. After the existing hair passes through the microtube, the wire, funnel, and microtube are removed, thus leaving the supplemental hairs coupled to the existing hair via the sleeve. An alternative system and method includes one or more tools for installing two halves of a sleeve with supplemental hairs extending therefrom onto a strand of existing hair. The one or more tools are configured to guide the strand of existing hair into engagement with the halves of the sleeve, thus securing the sleeve and the supplemental hairs on the strand of existing hair.

11 Claims, 22 Drawing Sheets

SYSTEM AND METHOD OF SUPPLEMENTING HUMAN HAIR VOLUME

CROSS REFERENCE TO RELATED APPLICATION

This application claims the benefit under 35 U.S.C. § 119(e) to U.S. Provisional Application 62/672,415 filed May 16, 2018, which application is incorporated by reference herein in its entirety.

TECHNICAL FIELD

The present disclosure is directed to supplementing existing human hair and, more particularly, to adding volume by attachment of additional hair strands to a host strand of hair.

BACKGROUND

Description of the Related Art

It is known that hair transplants only achieve a 30% to 50% increase in hair density. While an increase of 50% in hair density generally looks better, a lower density of hair improvement usually presents a thin head of hair. Ideally, the goal is to obtain a thickening of 100% or more of existing hair.

Prior methods of increasing hair density are problematic because of limitations on reusability. For example, adhesives have been used to glue or bond additional hair to an existing hair shaft. The difficulty with adhesives is that they are exposed to the elements, such as rain, the ocean, and sweat, as well as to chemicals from shampoo, which can break down the adhesive. When the adhesive breaks down, the bond fails, resulting in hair loss.

Other methods and devices include the use of metal clamps. Such clamps require special tools to attach the clamp to the hair. In order to adjust and accommodate growing hair, the clamps must be unclamped and reclamped, resulting in tedious and expensive labor. Metal fatigue is also an issue with these types of clamps. Moreover, the use of thousands of clamps in a head of hair may cause allergic reactions, and these clamps can be easily snagged or pulled with a comb or brush.

Another approach has been to use thermal plastic tubes that are shrunk onto the hair with the application of heat. Such heat-shrunk tubes are difficult to adjust because they require reheating, which can be damaging to existing hair and the scalp, and such tubes are usually not able to be reheated and reapplied.

In general, existing methods and devices are one-time applications only. The practicality of attempting to adjust these existing hair supplementation devices while attached to the existing hair makes them unusable, for all intents and purposes.

BRIEF SUMMARY

In accordance with one implementation of the present disclosure, a system and method for supplementing existing hair is provided, which can include thickening of the hair by adding hair extensions to a host hair to increase volume, such as density, or length, or both.

In one implementation, a system for increasing density or length, or both, of existing hair is described wherein a thermoplastic sleeve is formed with supplemental hairs extending therefrom. The supplemental hairs can be coupled to the thermoplastic sleeve in one of multiple ways described herein, such as by trapping the hairs between two layers of thermoplastic and coupling the layers together. Then, the sleeve is slid onto a small tube with an internal bore there through. The tube is coupled to a funnel, which also has an internal bore. A wire is passed through the internal bore of the tube and the funnel to be received in a v-shaped container. An existing hair is provided to the v-shaped container alongside the wire. Removable adhesive is used to couple the existing hair to the wire, which is drawn back through the funnel and the tube. In other words, the wire draws the existing hair through the funnel and the tube. Then, the funnel is removed and the sleeve is slid off of the tube onto the existing hair. In some cases, a blocking element is also positioned on the tube behind the sleeve, in which case, the blocking element is also slid off the tube and onto the hair. The sleeve is preferably elastic, such that when it slides off the tube, it is coupled to the existing hair. The blocking element is then closed securely around the existing hair with adhesive and the tube is slid off of the hair. The adhesive between the wire and the existing hair is removed with a solvent, leaving the sleeve secured to the existing hair and the supplemental hairs attached to the sleeve to increase hair density.

In another implementation, a support block has three sets of pliers coupled to the block and aligned with each other. The two outer pliers each have a notch or recess in one arm and a correspondingly sized and shaped wedge extending from the other arm. As such, the wedge is received in the notch when the pliers are closed. An existing hair is guided into the notch on the pliers closest to the user's scalp. Then, the pliers are closed to secure the hair between the notch and the wedge, in some cases with the assistance of a spring or other locking mechanism. Then, the existing hair is guided into the notch of the pliers farthest from the scalp and secured in a similar manner. At this point, the existing hair is in a defined three dimensional space between two sets of pliers. The middle set of pliers includes a half of a thermoplastic sleeve with supplemental hairs extending therefrom removably attached to each of the arms of the middle set of pliers with a weak adhesive. When the pliers are closed, strong adhesive bonds the inner surfaces of the halves of the sleeve together around the existing hair. The pliers can then all be released, with the sleeve securely attached to the hair and the supplemental hairs increasing hair density.

For example, an implementation of a system to increase hair density of existing hair includes: a container having a size and a shape to receive a wire and an existing hair to facilitate coupling the wire to the hair; a funnel comprising a first portion removably coupled to a second portion to define an internal bore having a first diameter and a second diameter, wherein the first diameter is greater than the second diameter and the second diameter is greater than the outermost diameter of the wire, wherein each of the first portion and the second portion include an external surface; a pair of pliers coupled to the funnel, the pliers having jaws with a first arm and a second arm, wherein the first arm is coupled to the external surface of the first portion of the funnel and the second arm is coupled to the external surface of the second portion of the funnel; a microtube having an internal bore and a handle extending from an external surface of the microtube, wherein the internal bore is sized and shaped to be slidably received over the existing hair; a sleeve having an external surface with one or more supplemental hairs extending therefrom and an internal bore sized and shaped to be slidably received over the external surface of the microtube; and a blocking element being configurable between an installed configuration and an uninstalled configuration, wherein in the installed configuration, the blocking element is coupled to the existing hair and an outermost diameter of the blocking element is greater than a diameter of the internal bore of the sleeve.

An alternative implementation of a system to increase density of existing hair includes: a support block; a first tool coupled to the support block and having a first arm rotatably coupled to a second arm, wherein the first tool is configured to removably secure existing hair between the first and second arms of the first tool; a second tool coupled to the support block, the second tool including a first arm rotatably coupled to a second arm, the first arm configured to receive a first sleeve half and the second arm configured to receive a second sleeve half; and a third tool coupled to the support block and having a first arm rotatably coupled to a second arm, the third tool configured to removably secure existing hair between the first and second arms of the third tool.

The implementation may further include: a recess in the first arm and a wedge extending from the second arm, the recess configured to removably receive the wedge; the first tool further including a spring coupled between the first arm and the second arm, the spring configured to exert a force to bias the wedge of the first tool towards the recess of the first tool; the third tool further including a recess in the first arm and a wedge extending from the second arm, the recess configured to removably receive the wedge; the third tool further including a spring coupled between the first arm and the second arm, the spring configured to exert a force to bias the wedge of the third tool towards the recess of the third tool; the support block further including a first post, the second arm of the first tool coupled to the first post, a second post, the second arm of the second tool coupled to the second post, and a third post, the second arm of the third tool coupled to the third post; the first sleeve half and the second sleeve half further including a first layer having a first recess, a second layer having a second recess and coupled to the first layer, the second layer at least partially received in the first recess, and supplemental hairs coupled between the first layer and the second layer; the second layer of the first sleeve half and the second layer of the second sleeve half further including respective flanges, the flanges configured to be coupled together; the second recess of the second layer of the first sleeve half and the second recess of the second layer of the second sleeve half configured to receive at least a portion of the existing hair.

An alternative implementation of a system to increase density of existing hair includes: a first layer having a first recess; a second layer having a second recess configured to at least partially receive existing hair, the second layer coupled to the first layer and at least partially received in the first recess, the second layer having flanges extending at least to an outermost surface of the first layer; and supplemental hairs coupled between the first layer and the second layer. The system may further include: a third layer having a first recess; a fourth layer having a second recess configured to at least partially receive existing hair, the fourth layer coupled to the third layer and at least partially received in the first recess of the third layer, the fourth layer having flanges extending at least to an outermost surface of the third layer; and supplemental hairs coupled between the third layer and the fourth layer, wherein the flanges of the second layer are configured to be coupled to the flanges of the fourth layer, the second recess of the second layer and the second recess of the fourth layer configured to receive at least a portion of the existing hair. In an implementation, the system includes: an adhesive on the second layer and the fourth layer; a first cover strip on the adhesive on the second layer; and a second cover strip on the adhesive on the fourth layer.

An implementation of a method to increase hair density of existing hair includes: forming a sleeve having an external surface with one or more supplemental hairs extending therefrom and an internal bore; sliding the sleeve onto a microtube having an internal bore; forming a funnel having a first portion removably coupled to a second portion to define an internal bore having a first diameter and a second diameter, wherein the first diameter is greater than the second diameter and the second diameter is greater than an outermost diameter of a wire and an outermost diameter of the microtube; coupling a pair of pliers to the funnel, the coupling including coupling a first arm of the pliers to an exterior surface of the first portion of the funnel and coupling a second arm to an exterior surface of the second portion of the funnel; inserting the microtube into the funnel; passing the wire through the inner bore of the microtube and the inner bore of the funnel; coupling an existing hair to the wire with an adhesive; drawing the wire back through the inner bore of the funnel and the microtube; separating the first and second portions of the funnel by applying a force to the pliers; sliding the sleeve off of the microtube onto the existing hair; and removing the adhesive coupling the wire to the existing hair. The method may also include: forming a blocking element; positioning the blocking element on the microtube prior to drawing the wire back through the funnel and the microtube; sliding the blocking element off of the microtube and onto the existing hair; and coupling the blocking element to the existing hair with an adhesive, wherein an outer diameter of the blocking element is greater than a diameter of the inner bore of the sleeve.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed implementations. However, one skilled in the relevant art will recognize that the present disclosed implementations may be practiced without one or more of these specific details, or with other methods, components, materials, etc. In other instances, well-known structures or components, or both, that are associated with the environment of the present disclosure have not been shown or described in order to avoid unnecessarily obscuring descriptions of the implementations.

Unless the context requires otherwise, throughout the specification and claims that follow, the word "comprise" and variations thereof, such as "comprises" and "comprising," are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

The present disclosure is directed to a system and method of using an elastic sleeve (or tube) to attach several supplemental hairs (synthetic or real) to a host hair, such as a human hair growing out of the scalp. In so doing, the hair density (i.e., the number of hairs per square inch) will be increased, giving the prospective user the potential for a fuller head of hair. Several procedures and components are utilized to create the sleeve, position the sleeve onto a component that can allow an installer to put the sleeve onto a host hair, and position the host hair into such a component.

Figure 1:
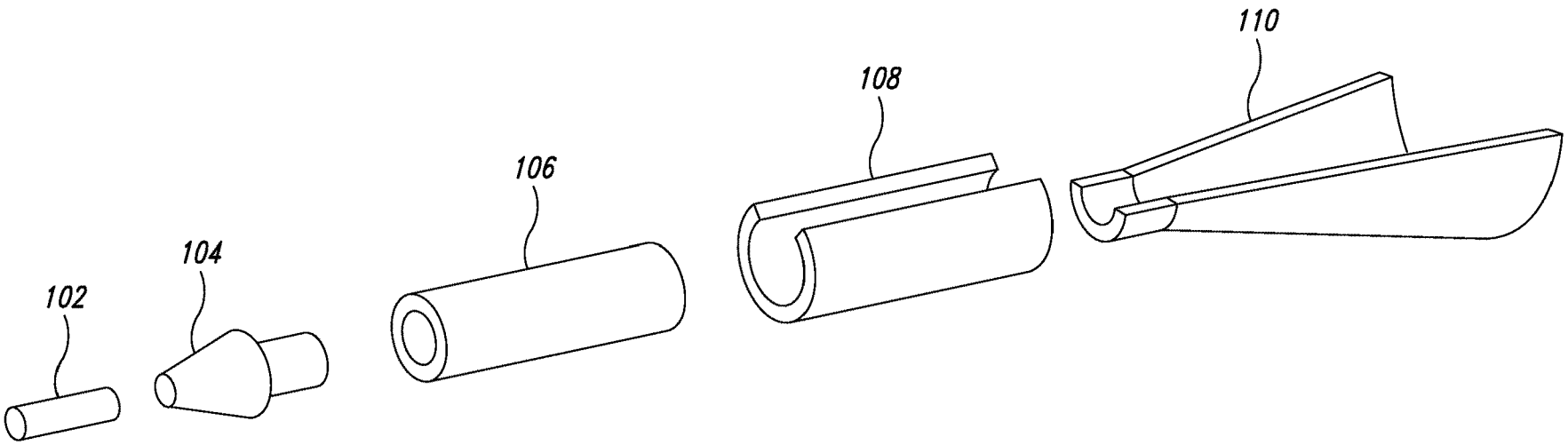
FIG. 1 is an exploded view of a supplemental hair installation system that includes a rod, a transitional member, a microtube, a connector member, and an acceptance member in accordance with the present disclosure.

FIG. 1 is an exploded view of a supplemental hair installation system in accordance with the present disclosure. The system includes a rod 102, a transitional member 104, a microtube 106, a connector member 108, and an acceptance member 110. Briefly, a sleeve 210 (shown in FIGS. 2A-2E) is formed onto the rod 102. The rod 102 is attached to the transitional member 104, which is inserted into the microtube 106. The sleeve is slid from the rod 102 up and over the transitional member 104 and onto the microtube 106. Once the sleeve is positioned on the microtube 106, the transitional member 104 and the rod 102 can be removed from the microtube 106. The acceptance member 110 is connected to the microtube using the connector member 108. The connector member 108 slides over a portion of the acceptance member and a portion of the microtube 106, but does not interfere with the sleeve on the microtube. The acceptance member 110 enables a host hair (not illustrated) to be inserted into the microtube 106. Once the host hair is inserted into the microtube 106, the connector member 108 and the acceptance member 110 can be removed from the host hair, leaving the microtube 106 on the host hair. The sleeve is then slid off the microtube 106 and onto the host hair, resulting in a host hair with a sleeve having one or more supplemental hairs. Each of the components illustrated in FIG. 1 and their function is described in more detail in the following description of the figures.

For ease of discussion, the outside diameters of the rod 102, the microtube 106, and a host hair (e.g., host hair 408) will be described in generic units to show the relationship between the different diameters of the various components. It should be recognized that each person's hair can have a different diameter (e.g., between 0.04 mm to 0.15 mm), so the units described herein can be adjusted for a specific diameter of hair, such as that of a user. In some implementations, example measurements may also be given. In various implementations, a target or average host hair diameter can also be used. In this way, small, medium, and large sleeves can be created for the different thicknesses of human hair.

FIGS. 2A-2E are side views of the process of creating a sleeve 210 with supplemental hairs 214 on a rod 102. In various implementations, a host hair may be assumed to have a width or diameter of two units. In this case, the rod 102 has an outside diameter of one unit, so that once formed onto the rod 102, a sleeve 210 has a natural diameter of one unit, which is smaller than the diameter of the host hair. In at least one implementation the diameter of the rod may be approximately 0.05 mm (e.g., if the rod is a 44 gauge wire), which results in a sleeve 210 with a natural internal diameter of approximately 0.05 mm.

Figure 2D:
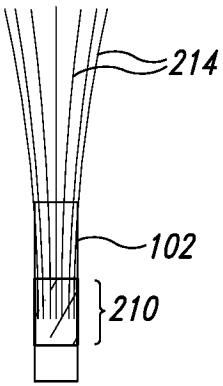
FIGS. 2A-2G are side views of the process of creating a sleeve with supplemental hairs onto the rod in accordance with the present disclosure.
Figure 2C:
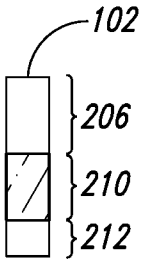
Figure 2B:
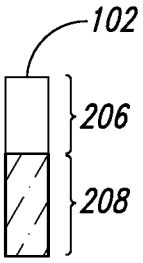
Figure 2A:
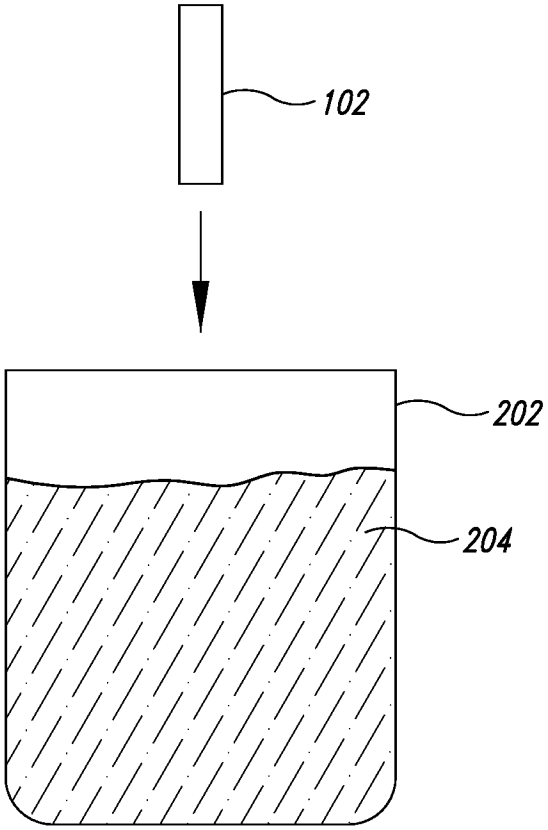

The rod 102 is dipped into a container 202 of liquid latex rubber 204, e.g., as illustrated in FIG. 2A. The liquid latex rubber 204 sticks to the rod 102 so that when the rod 102 is removed from the liquid latex rubber 204, a layer of wet latex 208 is formed on the rod 102. In some implementations, one or more portions 206 and 212 of the rod 102 may be treated or configured so that the liquid latex rubber 204 does not adhere to the rod 102, e.g., as illustrated in FIGS. 2B-2C. For example, portions 206 and 212 of the rod 102 may be nanocoated, covered in a release agent, or polished such that the sleeve 210 (once the liquid latex rubber cures) can easily slide on the rod 102. In this way, the sleeve 210 is created on the rod 102.

After the rod 102 is dipped into the liquid latex rubber 204, the supplemental hairs 214 are added to the sleeve 210, as illustrated in FIG. 2D. In various implementations, the supplemental hairs 214 may be aligned and laid on a flat surface. After the rod 102 is dipped into the liquid latex rubber 204 and before the liquid latex rubber has a chance to cure, the rod 102 is rolled through the supplemental hairs 214 so that the supplemental hairs 214 are substantially parallel to the rod 102 with one end of the supplemental hairs 214 being in the sleeve 210. It should be understood that other methods of positioning the supplemental hairs 214 into the liquid latex rubber of the sleeve 210 may be utilized. In some implementations, the supplemental hairs 214 may be coated with a bonding agent to help them bind to the latex rubber in the sleeve 210. After the supplemental hairs 214 have been added to the sleeve 210 and the sleeve 210 has cured, the rod 102 may be re-dipped into the container 202 of the liquid latex rubber 204 to add additional latex to the sleeve 210. In various implementations, this re-dipping procedure is performed such that the supplemental hairs 214 are not dipped into the liquid latex rubber 204, as illustrated in FIG. 2E. In this way, a coating of the liquid latex rubber 204 can form around the supplemental hairs 214 on the sleeve 210 without getting all over the supplemental hairs 214. These additional coatings can help stabilize and attach the supplemental hairs 214 to the sleeve 210.

In various implementations, the rod 102 may be dipped into the liquid latex rubber 204 one or more times (e.g., between four and ten times, or even more) before or after, or before and after, the supplemental hairs 214 are added to the sleeve 210. In some implementations, the supplemental hairs 214 may be added over the course of multiple coatings. For example, the rod may be dipped in the liquid latex and two hairs may be added to this first coat of the liquid latex. After the first coat cures, the rod may be dipped again to create a second coat. After the second coat cures, the rod may be dipped again and two more hairs may be added to this third coat. After the third coat cures, the rod may be dipped again, resulting in a sleeve with four coats of latex. It should be recognized that multiple coats can be used to create the sleeve and that one or more hairs can be added to one or more coats of the sleeve.

Figure 2F:
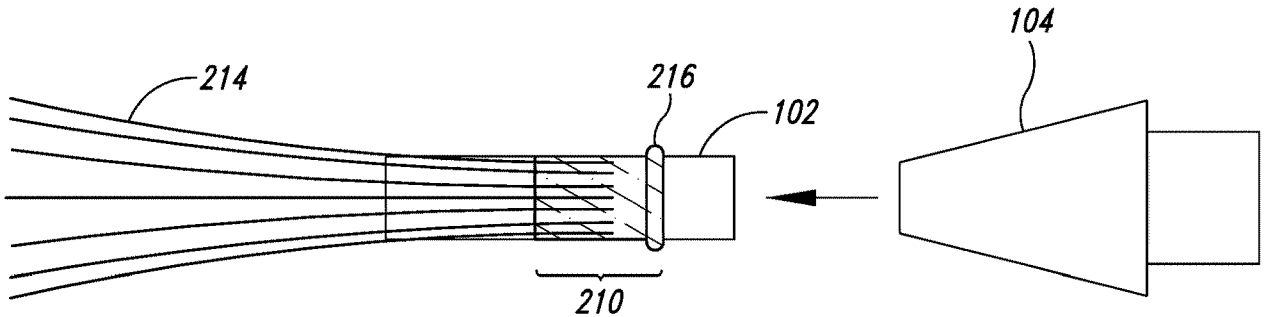

In various implementations, a ridge 216 may be formed on the sleeve 210, as shown in FIG. 2F. The ridge 216 provides a surface for a manufacturer to grab onto the sleeve 210 when moving the sleeve 210 from the rod 102 and onto the microtube 106, as described herein. In some implementations, the ridge 216 is removed once the sleeve is moved onto the microtube 106. But in other implementations, the ridge 216 is left on the sleeve 210 so that an installer has a surface to grab onto when adjusting a position of the sleeve on the host hair once the sleeve is installed on the host hair (e.g., move the sleeve closer to the scalp as the host hair grows out). The ridge 216 may be formed by performing multiple additional dips of the rod 102 into the liquid latex rubber 204, but only on a portion of the sleeve 210. Although the ridge 216 is described as being formed by multiple partial dips or coatings of the liquid latex rubber 204 on the sleeve 210, the disclosure is not so limited, and other methods of building up a ridge or ring on a liquid latex rubber cylinder may be employed, such as by rolling up the end of the sleeve.

Figure 2G:
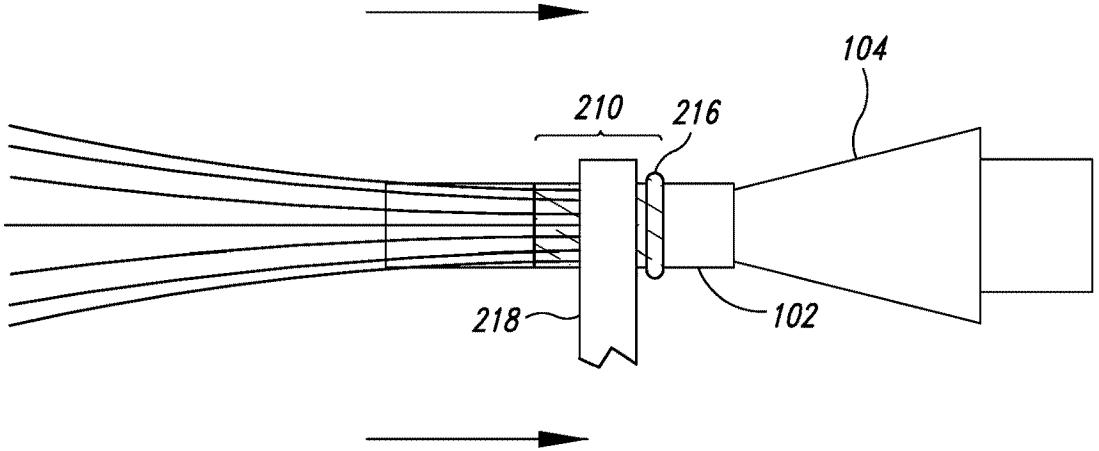
Figure 2E:
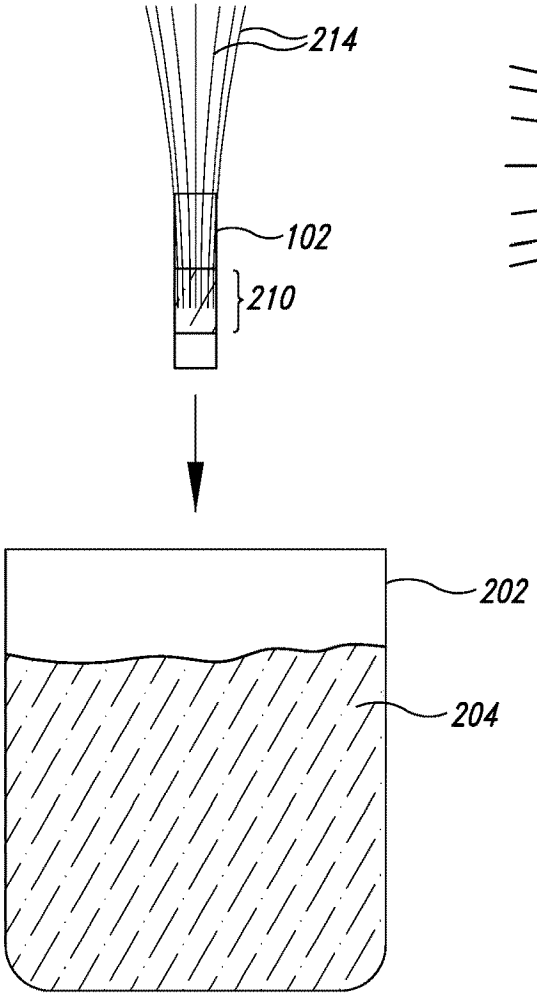
Figure 3A:
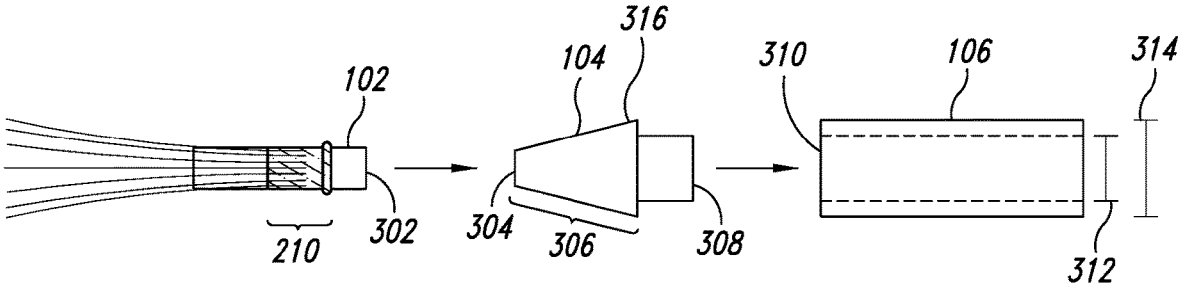
FIGS. 3A-3D are side views of the process of sliding the sleeve from the rod over the transitional member and onto the microtube in accordance with the present disclosure.
Figure 3B:
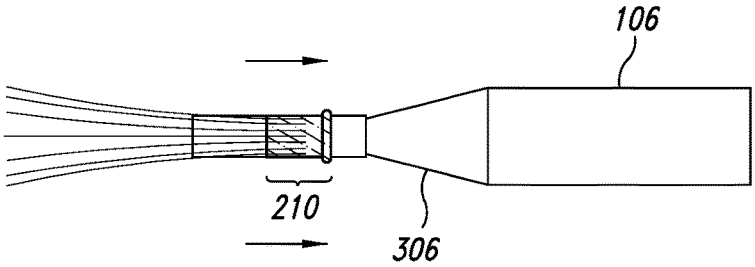
Figure 3C:
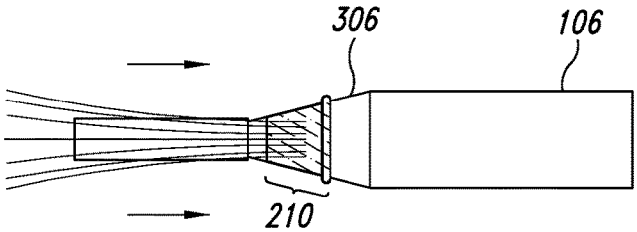
Figure 3D:
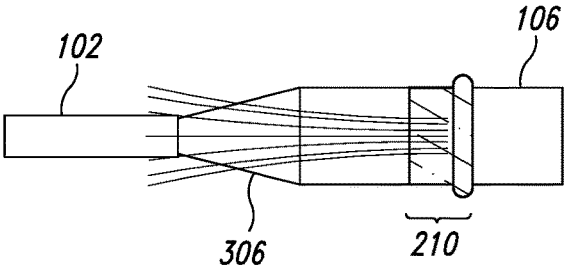
Figure 4A:
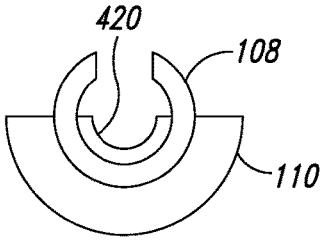
FIG. 4A is an end view of the connector member and the acceptance member in accordance with the present disclosure.
Figure 4B:
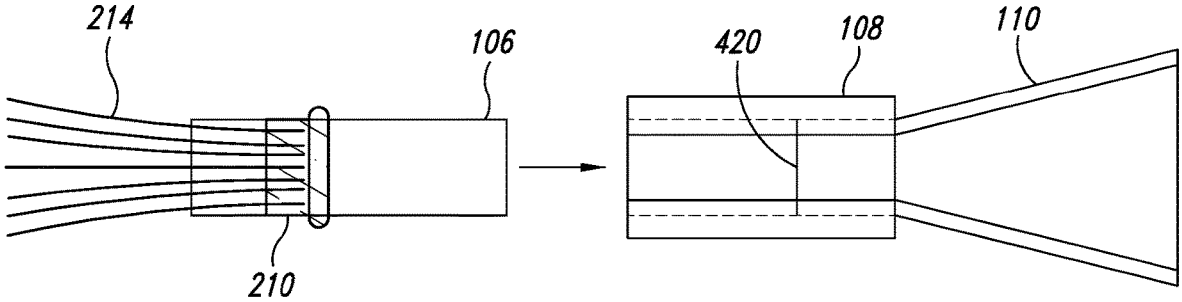
FIGS. 4B-4C are top views of the microtube, connector member, and acceptance member to accept a host hair in the microtube in accordance with the present disclosure.
Figure 4C:
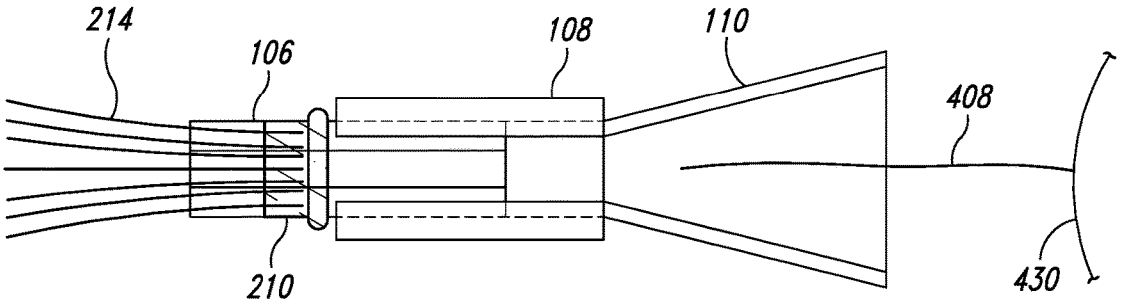
Figure 4D:
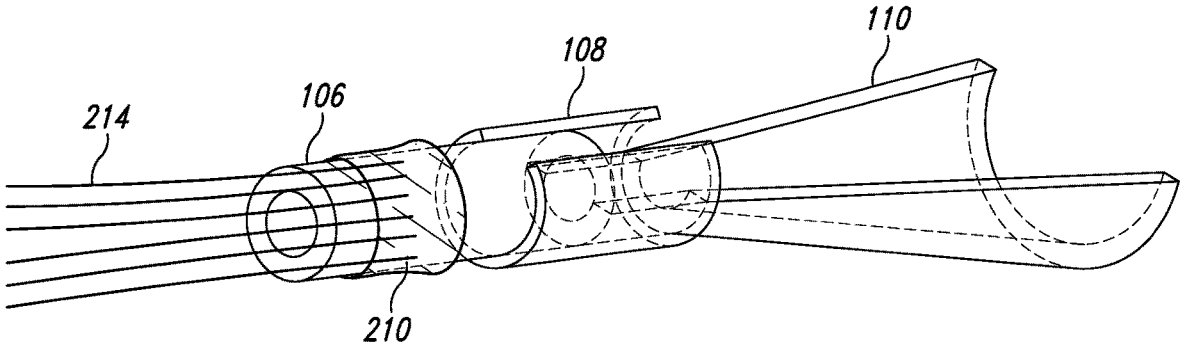
FIG. 4D is a perspective view of the microtube, connector member, and acceptance member to accept a host hair in the microtube in accordance with the present disclosure.
Figure 4E:
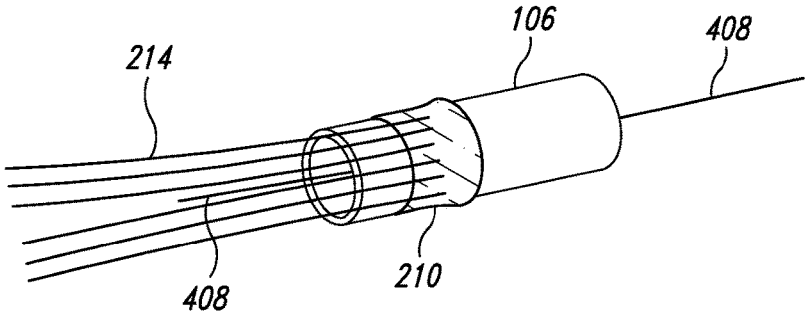
FIG. 4E is a perspective view of the microtube with a host hair in accordance with the present disclosure.

After the sleeve 210 is formed on the rod 102, the rod 102 is attached to the transitional member, as illustrated in FIGS. 2F and 2G. Pliers 218 are used to slide the sleeve 210 off the rod 102 and onto the transitional member 104, which is illustrated in FIG. 2G. The pliers 218 may be sized and shaped to be slightly curved to fit around the sleeve 210 and engage the ridge 216. The ridge 216 provides a surface for the pliers 218 to push against, to slide the sleeve 210 along the length of the rod 102. In some implementations, the pliers 218 may be fused into the ridge 216 by applying extra coats of liquid latex rubber.

In some implementations, the rod 102 may include micro grooves formed at an angle into the rod. The micro grooves may be formed such that when the rod 102 is dipped into the liquid latex rubber 204, the liquid latex rubber 204 picks up or maps these indentations, thus forming micro grooves on the inside diameter of the sleeve. In various implementations, the micro grooves may be angled in a same direction as the supplemental hairs 214 so that the sleeve 210 can only slide in one direction, which is opposite of the supplemental hairs 214. In this way, the sleeve 210 can still be slid from the rod 102 to the microtube 106 and onto a host hair, as described herein. And since the micro grooves are angled towards the supplemental hairs, the sleeve would resist moving in that direction once the sleeve is positioned on a host hair, while still allowing the sleeve to move towards the scalp for repositioning.

FIGS. 3A-3D are side views of the process of sliding the sleeve 210 from the rod 102 over the transitional member 104 and onto the microtube 106. In various implementations, the microtube 106 has an outside diameter of four units and an inside diameter of three units. In at least one implementation, the microtube 106 has an outside diameter of 0.2 mm and an inside diameter of 0.15 mm.

The transitional member 104 includes a tip 304, a midsection 306 and a base 316. In various implementations, the tip 304 has a diameter of one unit and the base 316 has a diameter of four units, and the midsection 306 has a diameter that is tapered from one unit at the tip 304 to four units at the base 316.

A first end 302 of the rod 102 is attached to the tip 304 of the transitional member 104 using an adhesive or other attachment compound. The tip 304 of the transitional member 104 is the same diameter as or slightly smaller than the outside diameter of the first end 302 of the rod 102, which helps to allow the sleeve 210 to slide from the rod 102 and onto the transitional member 104. In various implementations, the transitional member 104 is nanocoated, covered in a release agent, or polished such that the sleeve 210 can easily slide on the transitional member 104.

The transitional member 104 also includes a shaft 308 to engage the microtube 106 and temporarily connect the transitional member 104 to the microtube 106. The shaft 308 of the transitional member 104 has an external diameter that is sized and shaped to fit inside a first end 310 of the microtube 106, which has an internal diameter 312. The first end 310 of the microtube 106 abuts a base 316 of the transitional member 104. A diameter of the base 316 is the same as or slightly larger than a diameter 314 of the microtube 106, which helps to allow the sleeve 210 to slide from the transitional member 104 to the microtube 106.

Once the rod 102 is connected to the transitional member 104, and the transitional member 104 is engaged with the microtube 106, the sleeve 210 can be slid from the rod 102 onto the transitional member 104 and onto the microtube 106. In various implementations the microtube 106 has an outside diameter of four units (although some larger or smaller diameters may be employed, depending on the elastic properties of the sleeve 210). The midsection 306 of the transitional member 104 is sized and shaped to change the diameter of the sleeve 210 as the sleeve is slid from the rod 102 to the microtube 106. In various implementations, the midsection 306 is frustoconical or otherwise tapered from the tip 304 to the base 316. In various implementations, the microtube 106 is nanocoated, covered in a release agent, or polished such that the sleeve 210 can easily slide on the microtube 106.

After the sleeve 210 is completely on the microtube 106, the rod 102 and transitional member 104 are removed from the microtube 106. The connector member 108 and acceptance member 110 are then connected to the microtube 106 to allow a host hair to be positioned inside the microtube 106.

FIGS. 4A-4E show various views of the interaction between the microtube 106, the connector member 108, and the acceptance member 110, and the insertion of a host hair 408 into the microtube 106.

The connector member 108 enables the acceptance member 110 to couple to and abut the end of the microtube 106 so that the acceptance member 110 is temporarily connected to the microtube 106. The connector member 108 and the acceptance member 110 may be permanently connected, or they may be separate but engage with one another when inserting a free end of the host hair 408 into the microtube 106, as illustrated. The connector member 108 and the microtube 106 are sized so that the microtube 106 slides inside the connector member 108. The connector member 108 can be referred to as a two-thirds cylinder since it does not fully close around the microtube 106 and includes a gap along the length of the connector member 108. It should be recognized that the connector member 108 may be more or less than two-thirds, but sized and shaped so that the connector member 108 engages the microtube 106 when the microtube is partially inserted into the connector member 108, and so that the connector member 108 can be separated from the microtube 106 (by sliding the connector member 108 off the microtube 106) and removed from the host hair 408 once the host hair 408 is inserted into the microtube 106.

The acceptance member 110 is a half-funnel-like shape. The open half of the acceptance member 110 is positioned in a same direction as the gap in the connector member 108, which allows the acceptance member 110 to be removed from the host hair 408 once the host hair 408 is inserted into the microtube 106. When inserted into the connector member 108, the microtube 106 abuts a first end 420 of the acceptance member 110. The first end 420 includes a wall thickness that is the same as (or slightly larger than) the thickness of the wall of the microtube 106, such that the internal surface of the microtube 106 aligns with an internal surface of the acceptance member 110, which allows the host hair 408 to slide from the acceptance member 110 into the microtube 106 without interruption. In various implementations, the first end 420 has the same dimensions as the microtube 106, but is only a half section, again to allow the acceptance member 110 to be removed once the host hair 408 is inserted into the microtube 106.

In various implementations, the sleeve 210 may be created on the rod 102 and moved onto the microtube 106 by a manufacturer prior to installation. The manufacturer may also attach the connector member 108 and the acceptance member 110 to the microtube 106. This combination of components maybe provided to the installer as the resulting product (i.e., the sleeve with the supplemental hairs) and the installation tool (i.e., the microtube, connector member, and acceptance member). Therefore, a plurality of product/installation tools can be used by an installer (e.g., a hair stylist) to provide enhanced hair density for a user.

In other implementations, the connector member 108 and the acceptance member 110 may not be utilized to guide the host hair 408 into the microtube 106. Rather, a thread and lasso method may also be used. In at least one such implementation, the thread would pass through the microtube 106 from the end with the supplemental hairs 214 towards the user's scalp 430. On the end with the user's scalp 430 is a lasso configured into the thread. In this way, an installer can capture the host hair 408 with the lasso and then pull the thread back through the microtube 106, which results in the host hair 408 being pulled through the microtube 106. The sleeve 210 is then slid off the microtube 106 and onto the host hair 408, as discussed in more detail below.

In some other implementations, the sleeve 210 could be slid off the microtube 106 and onto the thread prior to a host hair being captured by the lasso. In this way, the installer would receive the sleeve 210 on a thread and lasso (without the microtube 106) and the installer can capture the host hair 408 with the lasso and then pull the host hair 408 through the sleeve 210 by pulling the thread and lasso back through the sleeve 210. In some implementations, the host hair or the thread, or both, may be lubricated to help enable the thread and host hair to be pulled through the sleeve. Similarly, the sleeve 210 may include a ridge 216, as discussed elsewhere herein, to help enable the installer to slide the sleeve onto the host hair.

Figure 5A:
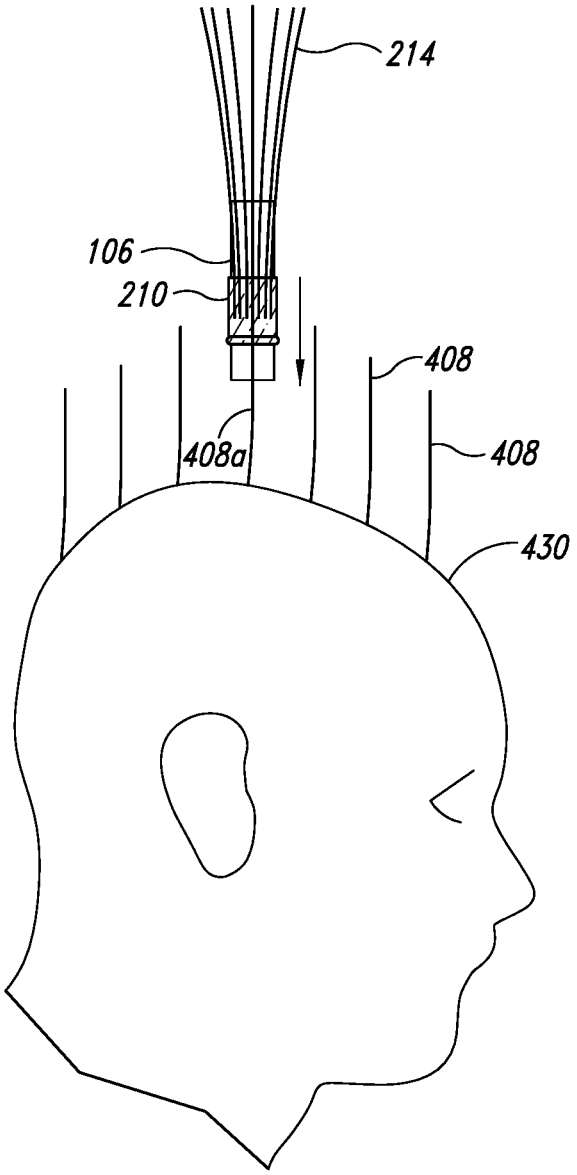
FIGS. 5A-5C are side views of the process for sliding the sleeve off the microtube and onto the host hair in accordance with the present disclosure.
Figure 5B:
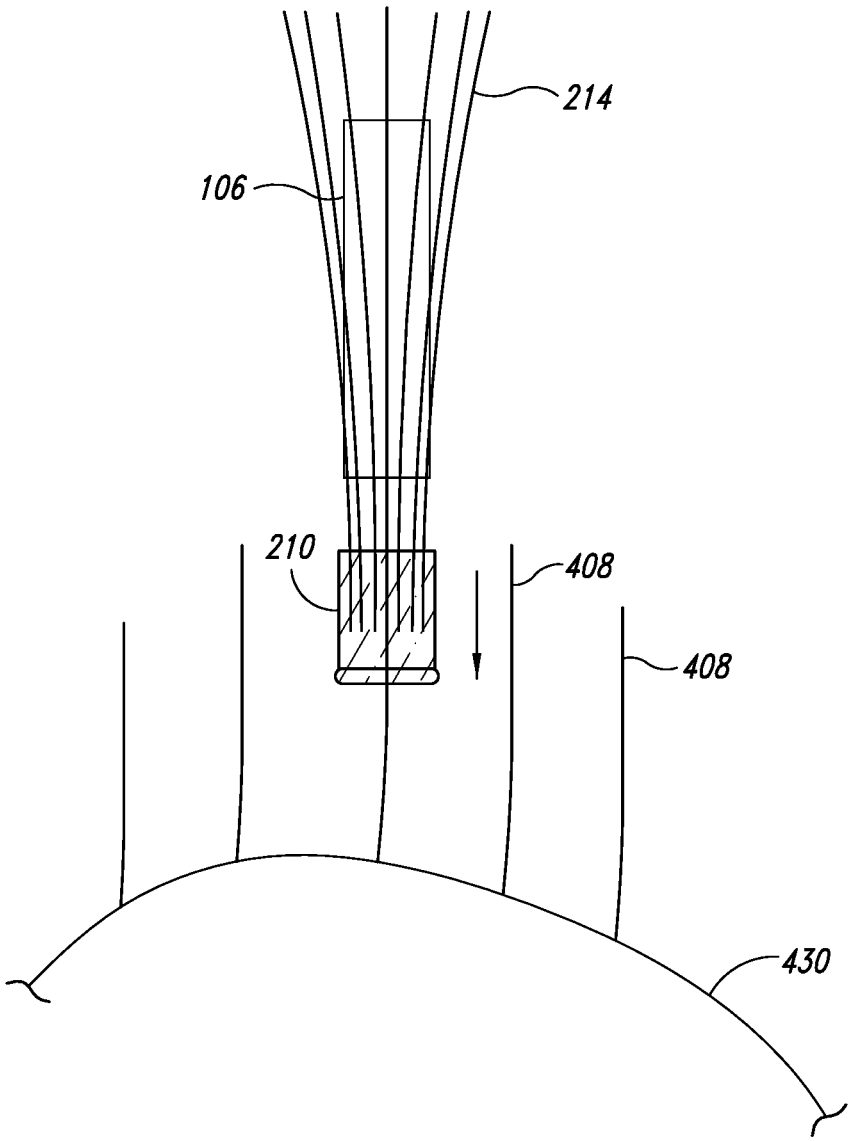
Figure 5C:
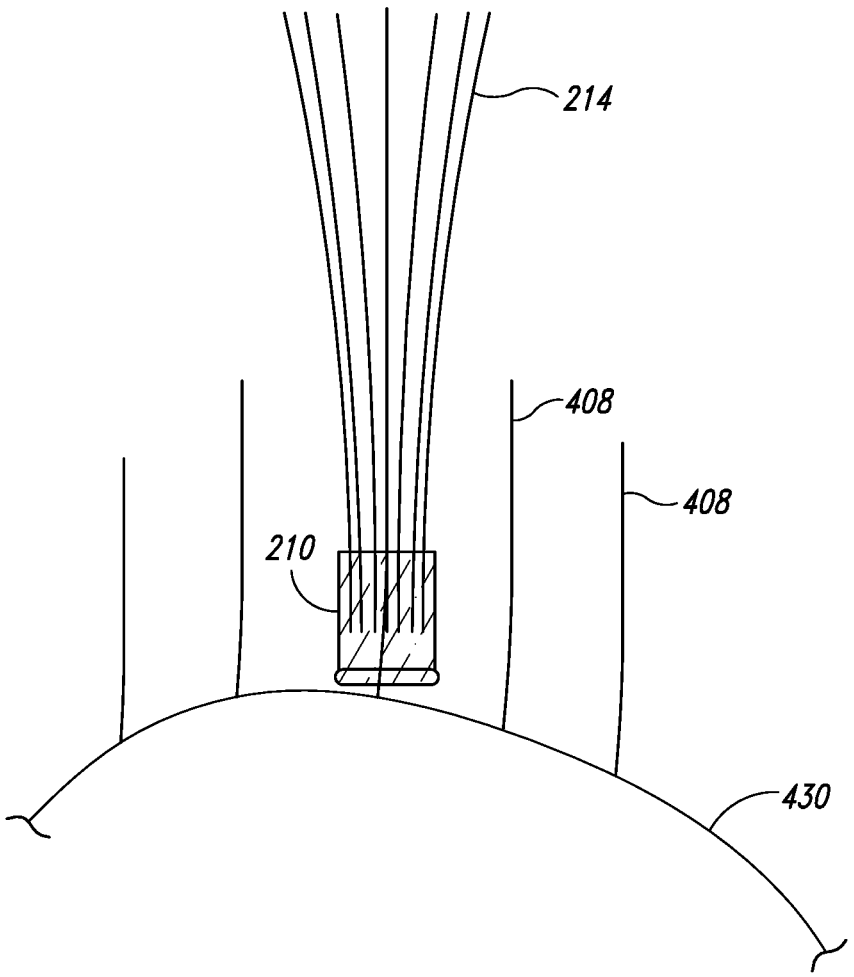

FIGS. 5A-5C are side views of the process for sliding a sleeve 210 off a microtube 106 and onto a host hair 408.

After a host hair 408*a* is inserted into the microtube 106, such as described above in conjunction with FIGS. 4A-4E, the sleeve 210 is slid down off the microtube 106 and towards the scalp 430. In some implementations, pliers (not illustrated), similar to what is described above, may be used to slide the sleeve 210 off the microtube 106. Since the sleeve 210 has a natural diameter that is smaller than the diameter of the host hair 408*a* (e.g., roughly the diameter of the rod 102 that the sleeve 210 was formed on), and since the diameter of the sleeve 210 was stretched when the sleeve 210 was moved from the rod 102 over the transitional member 104 and onto the microtube 106, the diameter of the sleeve 210 will shrink back to substantially its natural diameter when the sleeve 210 is slid off the microtube 106. And since the natural diameter is smaller than the diameter of the host hair 408*a*, the sleeve 210 will grip the host hair. Once the sleeve 210 is on the host hair 408 it may be positioned closer to the scalp 430, so that the sleeve 210 is hidden against the scalp 430 and under the supplemental hairs 214. It should be noted that a sleeve 210 may not be placed on every hair on a user's head, although they could be. Rather, a separate sleeve 210 may be placed on every fifth hair (or other density), such that if a hair with a sleeve falls out another sleeve 210 can be placed onto an adjacent host hair.

In some implementations, an adhesive may also be added to the sleeve 210 to further ensure that the sleeve 210 will stay on the host hair 408. The adhesive may be added to the host hair 408 prior to sliding the sleeve 210 off the microtube 106 and onto the host hair 408. Alternatively, or additionally, the adhesive may be added to the outside of the microtube 106, such that the inside of the sleeve 210 becomes at least partially coated with the adhesive when the sleeve 210 is slid off the microtube 106 and onto the host hair 408. In yet other implementations, the sleeve 210 itself may be pre-conditioned with adhesive, such as a heat sensitive adhesive that activates under higher temperatures.

Figure 6:
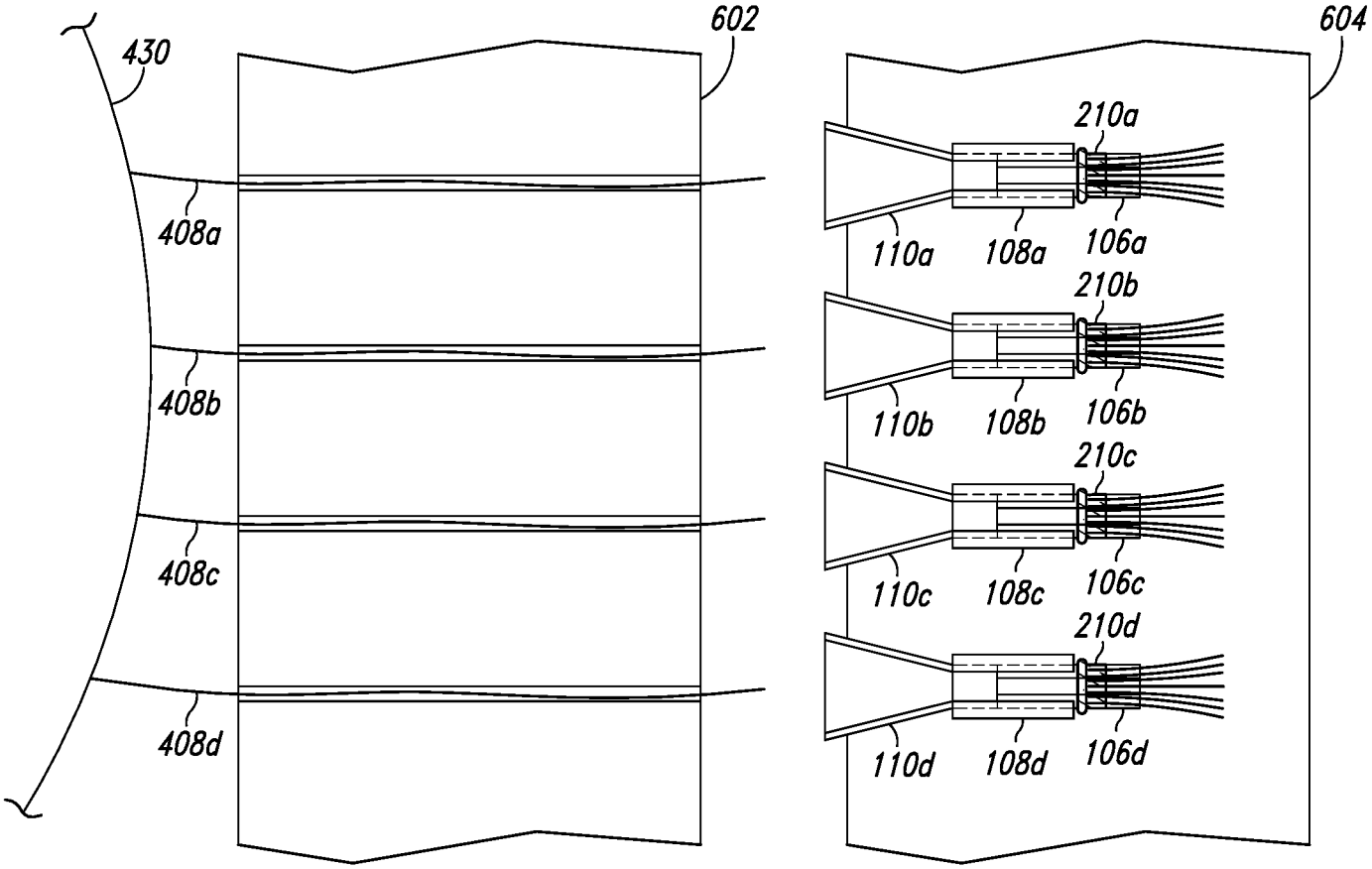
FIG. 6 is a top view of a plurality of plates that are used to insert multiple hairs into multiple sleeves at once in accordance with the present disclosure.

FIG. 6 is a top view of a plurality of plates that are used to insert multiple host hairs 408*a*-408*d* into multiple sleeves 210*a*-210*b* at once. A first plate 602 includes a plurality of grooves for each separate host hair 408*a*-408*d* to be arranged in a direction away from a user's scalp 430. A second plate 604 includes a plurality of product/installation tools that are created as described herein. When the plates 602 and 604 are aligned, the host hairs 408*a*-408*d* align with the corresponding acceptance members 110*a*-110*d*, which allows the host hairs 408*a*-408*d* to be slid into the corresponding microtubes 106*a*-106*d*. Once the host hairs 408*a*-408*d* are slid into the corresponding microtubes 106*a*-106*d*, the connector members 108*a*-108*d* and the acceptance members 110*a*-110*d* are removed so that the sleeves 210*a*-210*d* can be slid off the corresponding microtubes 106*a*-106*d* and onto the corresponding host hairs 408*a*-408*d*, as described above.

Figure 7A:
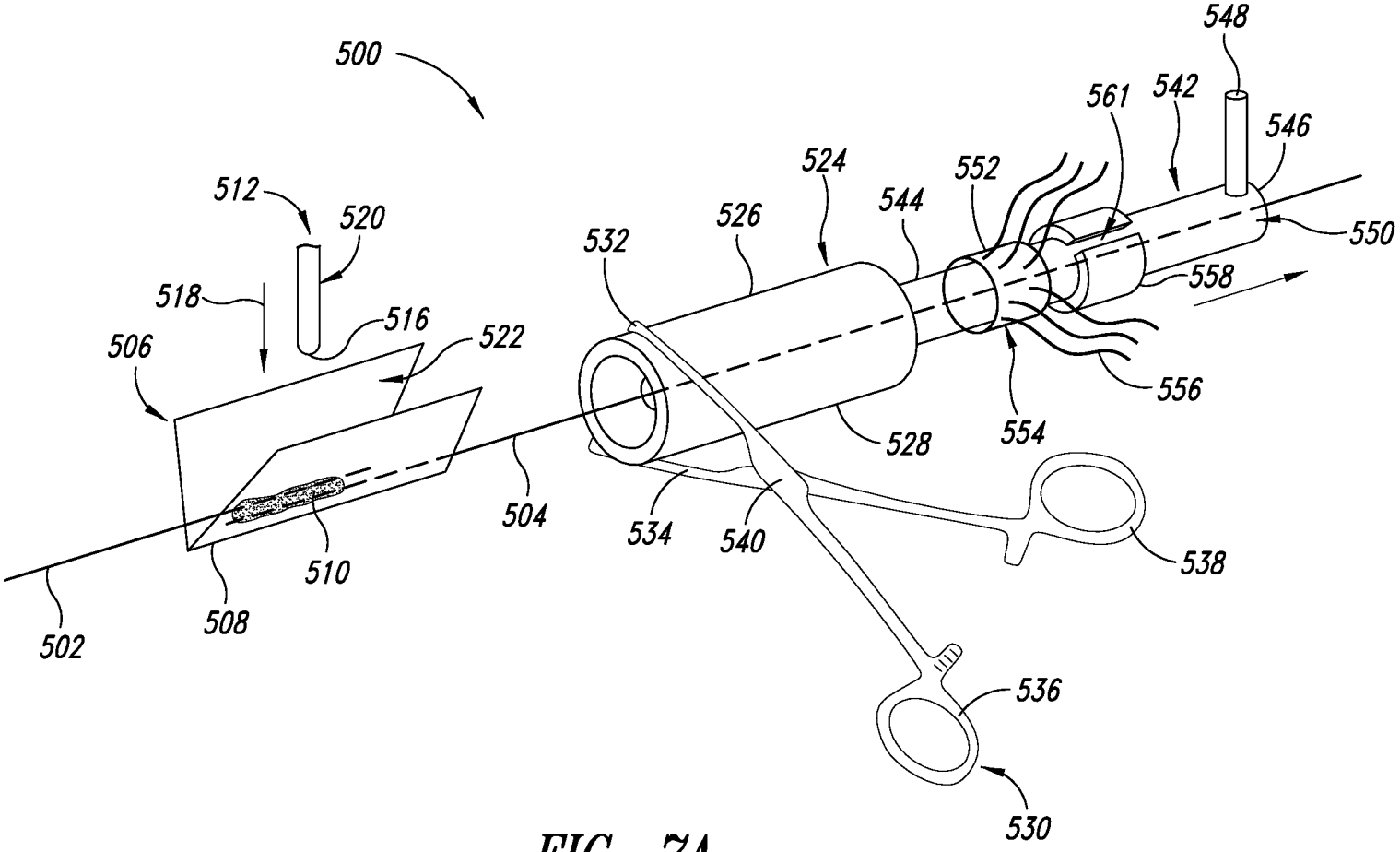
FIG. 7A is a perspective view of an alternative implementation of a supplemental hair installation system that includes a container, a funnel, a microtube inserted into the funnel, a sleeve on the microtube, and a wire passing through the microtube and funnel for drawing existing hair through the system in accordance with the present disclosure.
Figure 7B:
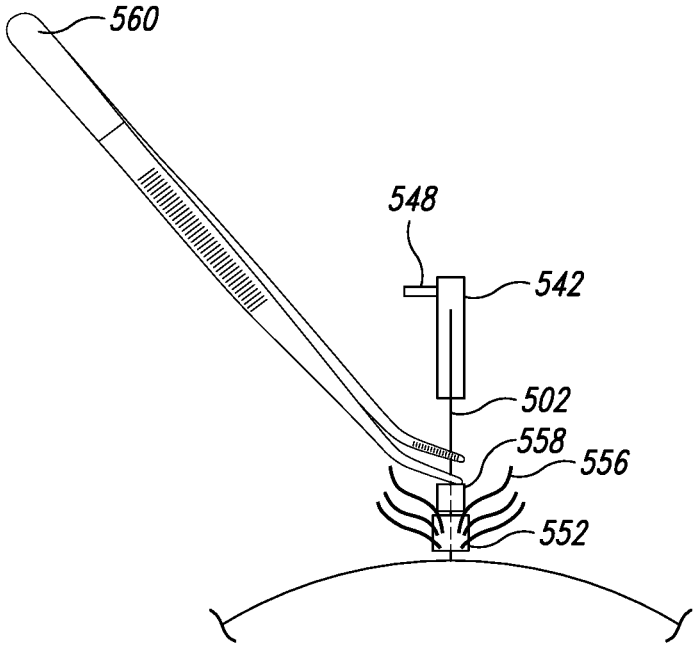
FIG. 7B is a side view of the supplemental hair installation system of FIG. 7A illustrating the sleeve coupled to the existing hair by a blocking element in accordance with the present disclosure.
Figure 7C:
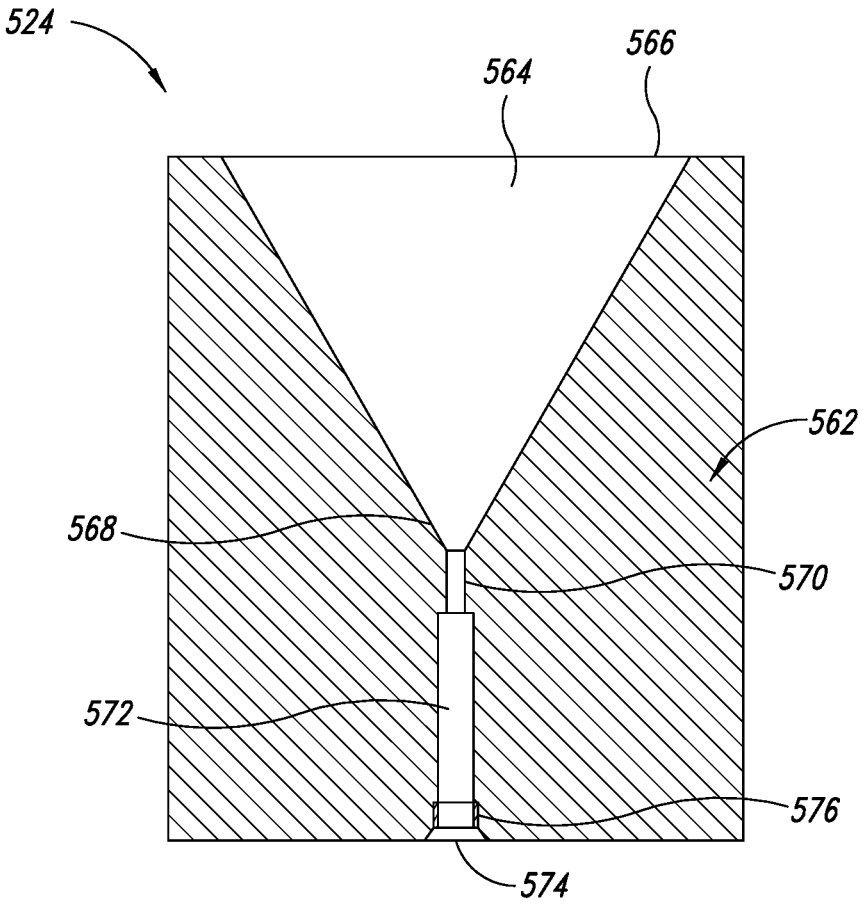
FIG. 7C is a cross-sectional view of the funnel of FIG. 7A in accordance with the present disclosure.

FIGS. 7A-7C illustrate an alternative implementation of a system 500 to increase hair density of existing hair 502. FIG. 7A is a perspective view of the system 500, which includes a wire 504 and a container 506. The container 506 has a size and a shape to receive the wire 504 and the existing hair 502 to facilitate coupling the wire 504 to the hair 502 as described herein. Preferably, the container 506 is generally in the shape of a "V" such that the wire 504 and the existing hair 502 rest toward a bottom 508 of the container 506 when the wire 504 and the hair 502 are inserted into the container 506. Adhesive 510, which may be any number of commercially available glues, such as eyelash glue, bonds the wire 504 to the hair 502. Adhesive 510 may be present within the container 506 before the wire 504 and the hair 502 are added to the container 506, or adhesive 510 may be placed by an installer after wire 504 and hair 502 are added to the container 506.

In an implementation, a tool 512, preferably with a blunt, pressing edge 516, is applied by a user with a generally downward force, which is represented by the downward arrow 518, to press the wire 504 against the hair 502, wherein the adhesive 510 effectively couples the wire 504 to the hair 502 within the container 506. Additionally, an outer or external surface 520 of the tool 512 and an inner surface 522 of the container 506 may be coated with an anti-adhesive material to resist adhesion of the adhesive 510. Such a coating may be Teflon®, although other anti-adhesive materials may be used.

The funnel 524 includes a first portion 526 and a second portion 528. In various implementations, the first portion 526 is a top portion and the second portion 528 is a bottom portion, and vice versa, while in other implementations, the first portion 526 is a left portion and the second portion 528 is a right portion, and vice versa. It is preferable, but certainly not required, that the portions 526, 528 be opposite one another and of a substantially similar size and shape. The portions 526, 528 are removably coupled together to form the funnel 524. In an implementation, the portions 526, 528 are held together by pliers 530. Additional detail regarding the funnel 524 will be provided with reference to FIG. 7C below.

The pliers 530 include first and second arms 532, 534. The first arm 532 includes a first handle 536 and the second arm 534 includes a second handle 538. The arms are coupled together at 540, which in an implementation, is a rotational joint. In a further implementation, the first arm 532 is fused to the first portion 526 of the funnel 524, and the second arm 534 is fused to the second portion 528 of the funnel 524. Further, the arms 532, 534 of the pliers 530 may be locked together, such that the portions 526, 528 of the funnel 524 are held in place by the pliers 530 until the installer applies pressure to the handles 536, 538. Additionally or alternatively, the funnel 524 and portions 526, 528 are held together with an adhesive or other forms of releasable fastening (not shown), which again, are released when the installer applies a force to the handles 536, 538 of the pliers 530, as described herein. "Fusing" as used herein may include, but is not limited to, the arms 532, 534 of the pliers 530 being formed integrally with the funnel 524, melted to the funnel 524, or coupled to the funnel 524 with adhesive or other fasteners. In addition, it is to be understood that the coupling or fusing of the pliers 530 to the funnel 524 includes the arms 532, 534 of the pliers 530 attached to an external surface of the funnel 524, or to an internal surface of the funnel 524, or even within a body of the funnel 524.

The system 500 further includes a microtube 542 having a first end portion 544 and a second end portion 546, and an internal bore extending there through. The microtube 542 is a hollow cylinder, such as a needle, with an inner diameter that is preferably equal to, or up to several times larger than a diameter of existing hair 502. In other words, the inner diameter of the microtube 542 is preferably at least great enough to enable the wire 504 and the existing hair 502 to slide there through. The first end portion 544 is inserted into the funnel 524 as described herein. The second end portion 546 includes a handle 548, which enables the installer to easily grasp and control the microtube 542 while performing implementations of the installation methods of the present disclosure. In an implementation, the handle 548 extends from an outer surface 550 of the microtube 542 proximate the second end portion 548, and has a generally cylindrical shape. However, one of skill in the relevant art will appreciate that the handle 548 can be located anywhere along a length of the microtube 542 and that although the microtube 542 and the handle 548 are generally illustrated as cylindrical, that the same can have any number of various shapes.

FIG. 7A further illustrates a sleeve 552, which is substantially similar to sleeve 210 discussed above. Sleeve 552 includes an external surface 554 with one or more supplemental hairs 554 attached to the external surface 554 and extending from the sleeve 552, as described herein. Preferably, the sleeve is a hollow cylinder with an internal bore that is sized and shaped to be slidably received on the microtube 542, as illustrated in FIG. 7A. In addition, the sleeve 552 is comprising of an elastic material, such that a diameter of the inner bore of the sleeve 552 is less than an outermost or external diameter of the microtube 542, and the sleeve 552 is stretched to slide onto the tube 542, wherein in the stretched configuration, the sleeve 552 has the inner bore with a diameter preferably equal to or slightly larger (i.e., ⅛ of an inch larger) than the outermost or external diameter of the microtube 542.

In some implementations, the system 500 includes a blocking element 558 with a similarly hollow, cylindrical shape. In other words, in some implementations, the blocking element 558 has a circular cross section along its length and a solid sidewall (i.e. no gaps in the sidewall along a length of the blocking element 558). In such an implementation, the blocking element 558 may comprise latex rubber, although other materials may be used, such as thermoplastic, silicone, or various tapes. The blocking element 558 may be positioned on the microtube 542 for installation or may be installed separately, as described below. In some implementations, the 558 does not require adhesive to secure the blocking element 558 on the hair 502, while in other implementations, eyelash glue or other adhesive is positioned on an interior surface of the element 558, as described herein, to further secure the blocking element 558 to the hair 502. In still further implementations, the blocking element 558 includes a gap 561 along its length, such that the blocking element 558 is in a "C" shape. The gap 561 of the blocking element 558 enables the blocking element 558 to be placed on the microtube 542 from any side, slid onto the microtube 542, or independently attached to the existing hair 502 during or after installation, as described herein.

FIG. 7B is a side view illustrating the sleeve 552 coupled to the existing hair 502 by the blocking element 558. During the installation process, as described below, the installer can grasp the handle 548 of the microtube 542 and use a tool 560, such as tweezers or forceps, to slide the sleeve 552 off of the tube 542 and onto the existing hair 502. In implementations that include the blocking element 558 on the microtube 542, as illustrated in FIG. 7A, the installer can also slide the blocking element 558 off of the microtube 542 and onto the existing hair 502. In such a scenario, the blocking element 558 preferably includes adhesive, or adhesive is added after sliding the blocking element 558, such that the gap 561 is closed. In other words, the blocking element 558 is configurable between an installed and an uninstalled configuration.

FIG. 7A illustrates the blocking element 558 in an uninstalled configuration, wherein the gap 561 is open. FIG. 7B illustrates the blocking element 558 in an installed configuration, where the gap 561 is closed via adhesive, such that the blocking element 558 is securely physically coupled to the existing hair 502. In the installed configuration, an outermost diameter of the blocking element 558 is preferably greater than a diameter of the internal bore of the sleeve in its relaxed (i.e., not subject to any force) configuration. In addition, because adhesive is not used with the sleeve 552, the sleeve 552 easily slides along the hair 502. As such, when the hair 502 naturally grows from the scalp, the sleeve 552 can easily be slid down with the tool 560 and another blocking element 558 installed to prolong the useful life of the sleeve 552. Once the blocking element 558 is in place, the supplemental hair or hairs 556 increase hair density of existing hair 502 as explained herein.

In addition, certain implementations of the blocking element 558 include forming a handle (not shown) on the blocking element 558, such that a sponge or other device (not shown) coated in adhesive can be used to swab the inside surface of the blocking element 558 prior to installation. This handle (not shown) is preferably a piece of plastic with a base portion affixed along a length of the blocking element 558 using a weak or mild adhesive, for example Scotch® tape, with a handle extending from the base portion. In an implementation, the handle (not shown) is opposite the gap 561 of the blocking element 558. The handle can be used to control the blocking element 558 and align it for installation on the hair 502. For example, the handle (not shown) extends from the blocking element 558 such that the installer may grasp the handle (not shown) while applying the eyelash glue. Then, the installer may use the handle (not shown) to assist in installation of the blocking element 558 by holding the handle (not shown) and aligning the gap 561 of the blocking element 558 with the hair 502 of the user, and then inserting the hair 502 into the internal bore of the blocking element 558 through the gap 560. Then, the handle (not shown) may be removed by separating the handle (not shown) from the blocking element 558. Further, the blocking element 558 can include a belt (not shown) having an adhesive on a surface facing the blocking element 558, wherein the belt (not shown) at least partially encircles the blocking element 558 with a tab covering a portion of the adhesive surface. After the blocking element 558 is on the hair 502, the tab is removed and the belt (not shown) is wrapped around a further portion of the blocking element 558, such as across the gap 561, to further secure the blocking element 558 in the closed configuration.

In certain other implementations, the blocking element 558 as shown in FIG. 7A is not used. Rather, a blocking element 596, as shown in FIG. 7F, is formed by opposing strips of adhesive 594*a* and 594*b* that are joined together behind the sleeve 552 after installation of the sleeve 552 so as to form a full circle around the hair 502. In such an implementation, a tool 590 is used with ends 592*a* and 592*b* of the tool 590 having a width corresponding to a desired length of the blocking element 596 (for example, the width may be ⅛, 3/16, or ¼ of an inch, or more or less). Then, strips 594*a* and 594*b* having adhesive on an interior surface and a similar width are removably coupled to the ends 592*a* and 592*b* of the tool 590 such that when the ends 592*a* and 592*b* of the tool 590 bearing the strips 594*a* and 594*b* are pressed together, the adhesive on surfaces of the strips facing each form a strong bond, with the strips 594*a* and 594*b* completely enclosing or surrounding the hair 502. In an implementation, the strips 594*a* and 594*b* are removably coupled to the ends 592*a* and 592*b* of the tool 590 with a weak adhesive. For example, the strips 594*a* and 594*b* may have a first adhesive on a surface to be coupled to the ends 592*a* and 592*b* of the tool with a lower bonding strength compared to a second adhesive on the interior surface of the strips 594*a* and 594*b* for joining the strips 594*a* and 594*b* together. As such, once the strips 594*a* and 594*b* are joined together, ends 592*a* and 592*b* of the tool 590 can be removed without impacting the bond between the strips 594*a* and 594*b*. Thus, the adjoining strips 594*a* and 594*b* form the blocking element 596 that traps the sleeve 552 adjacent the scalp of the user.

Further, one of skill in the art will appreciate that the useful life of implementations of the blocking element 558 (i.e. how long it remains on host hair 502) varies according to the length of the blocking element, its structure (i.e. whether it wraps around the hair 502, or has the gap 561), and the adhesive used, if any, to secure the blocking element 558 to the hair 502. Preferably, the blocking element 558 is configured to remain on the user's hair 502 for at least one month, and more preferably about 2 months, although in certain implementations, the blocking element 558 may remain for more or less than one to two months. One of skill in the art will understand that one advantage of the blocking element 558 falling off on its own over time lies in its efficiency, as no additional installation step is required to remove prior blocking elements 558 when new blocking elements are installed, or other adjustments are made. Further, the useful life of the blocking element 558 is preferably aligned with a desirable period of time between installation and any necessary adjustments. In other words, the useful life of the blocking element 558 is designed to match the period of time that it takes for the hair 502 to grow from the scalp, such that the user should have the sleeve 552 adjusted and a second roadblock installed.

FIG. 7C is a cross-sectional view of the funnel 524. One of skill in the relevant art will understand that the illustration in FIG. 7C may also represent an interior surface 562 of either or both of the portions 526, 528 that are joined together to form the funnel 524. The funnel 524 includes the internal longitudinal axial bore extending there through, wherein the bore comprises a funnel portion 564 connected to an inlet portion 570 connected to a tube portion 572 connected to an exit portion 574. In the illustrated implementation, the funnel portion 564 further includes a first portion 566 and a second portion 568. Preferably, a diameter of the first portion 566 is greater than a diameter of the second portion 568, wherein sidewalls of the funnel portion 564 are sloped from the first portion 566 to the second portion 568.

Further, an internal diameter of the inlet portion 570 is preferably substantially equal to the internal diameter of the second portion 568 of the funnel portion 564, and at least equal to or greater than the outside diameter of the wire 504. An internal diameter of the tube portion 572 is preferably greater than the diameter of the inlet portion 570 and is sized and shaped to receive the microtube 542 in a contact or friction fit, as in FIG. 7A, such that the bore of the microtube 542 aligns with the inlet portion 570. Preferably, the internal diameter of the tube portion 572 is large enough that when the tube 542 is inserted into the tube portion 572, the wire 504 can be pulled through the funnel 524 without catching on edges of the tube 542. To assist in holding the microtube 542 in place in the funnel 524 and the tube portion 572, the funnel 524 includes a nylon ring 576, which in an implementation, is proximate the exit portion 574. In other implementations, the nylon ring 576 is proximate the tube portion 572. The nylon ring 576 is inserted between the microtube 542 and the funnel 524 and is preferably compressible with an external diameter slightly larger than an internal diameter of the funnel 524 so that a friction fit is achieved between the ring 576 and the funnel 524 when the microtube 542 is inserted into the funnel 524. During installation, the nylon ring 576 can be removed with a tool, which may be nail clippers or scissors.

Figure 7D:
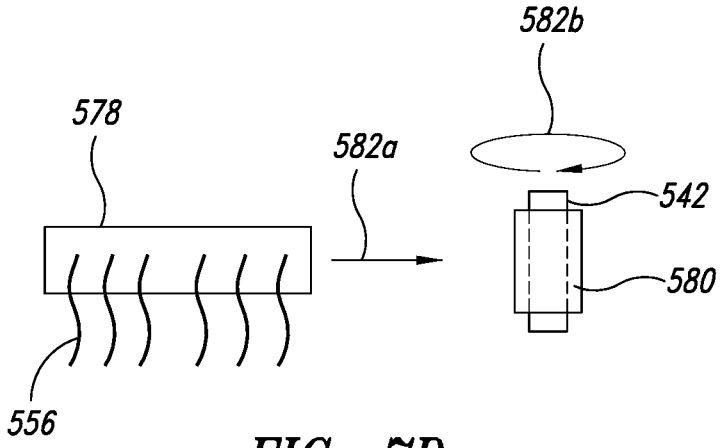
FIG. 7D is a side view of a process for attaching supplemental hairs to the sleeve of FIG. 7A in accordance with the present disclosure.

FIG. 7D illustrates a side view of a process for forming the sleeve 552. The sleeve 552 includes a first thermoplastic portion 578 and a second thermoplastic portion 580, wherein the second thermoplastic portion has a size and a shape to receive the wire 504 in a relaxed state, and elastic properties to be slidably received on the microtube 542 in a tensioned state, as in FIG. 7D. The two thermoplastic portions 578, 580 preferably have different melting points.

More preferably, the first thermoplastic portion 578 has a lower melting point than the second thermoplastic portion 580. The first thermoplastic portion 578 is melted together with the supplemental hairs 556. While this first thermoplastic portion 578 is still "molten," or in a semi-solid state between solid and liquid, the portion 578 is wrapped around the second thermoplastic portion 580, as generally indicated by arrows 582*a* and 582*b*. Because the second thermoplastic portion 580 has a higher melting point than the first thermoplastic portion 578, the second thermoplastic portion 580 will not be deformed by this assembly process. The sleeve 552 is the resulting combination of the portions 578, 580. Further, one of skill in the art will appreciate that this process can be carried out manually or automatically. In some implementations, a length of the second thermoplastic portion 578 is several times a circumference of the second thermoplastic portion 580. As such, the first thermoplastic portion 578 may be wrapped around the second thermoplastic portion 580 several times, which creates several "layers" of supplemental hairs 556, thus enabling various densities of supplemental hairs 556 to be associated with the sleeve 552.

In certain other implementations, the first thermoplastic portion 578 can include a mild adhesive, similar to a Band-Aid® bandage or Scotch® tape. Thus, supplemental hairs 556 can be attached to the adhesive on the first thermoplastic portion 578 and the first thermoplastic portion 578 can be wrapped around the second thermoplastic portion 580 and itself, wherein the first thermoplastic portion 578 is temporarily affixed to the second thermoplastic portion 580 via the adhesive on the first thermoplastic portion 578. Then, a clamp (not shown) or other device, which may include a heating element (not shown) for heating the clamp (not shown), surrounds and compresses the first thermoplastic portion 578 and the combination of heat and pressure causes the first thermoplastic portion 578 and the supplemental hairs 556 to melt or fuse to the second thermoplastic portion 580. Because the thermoplastic portions 578 and 580 preferably have different melting points as explained above, the second thermoplastic portion 580 is not melted by this adhesion process.

A further alternative implementation includes the second thermoplastic portion 580 including the adhesive described above, wherein the supplemental hairs 556 are attached to the second thermoplastic portion 580 via the adhesive. Then, the resulting combination is dipped into a container of thermoplastic having a lower melting point than a melting point of the second thermoplastic portion 580, thus securing the hairs 556 in the newly formed thermoplastic coating and also permanently attaching the hairs 556 to the second thermoplastic portion 580. This implementation may be performed while the second thermoplastic portion 580 is on the microtube 524.

There are several viable alternative implementations for forming the second thermoplastic portion 580, which may be a "naked" thermoplastic sleeve (i.e., a sleeve without hairs 556 extending therefrom). One option is to dip a 50 gauge (or other size) wire into liquid thermoplastic, thus creating a tube around the wire that will have an inside diameter that is less than the diameter of a human hair. The resulting tube would occupy a portion of the wire 504, leaving another portion of the wire 504 bare. The tube of thermoplastic could be cut to size to form the second thermoplastic portion 580, and then the first thermoplastic portion 578, including the hairs 556, could be installed to create sleeve 552 according to implementations of the present disclosure.

A second option is to use a hole saw (not shown) in combination with a guide tube (not shown) and the microtube 524. The guide tube (not shown) is coupled to the hole saw (not shown) and the microtube 524 is received in the guide tube (not shown) such that the microtube 524 is aligned centrally with respect to the guide tube and the hole saw. Preferably, an end of the microtube 524 protrudes from the hole saw (not shown) and the hole saw (not shown) includes a serrated edge proximate the protruding end of the microtube 524, such that when the microtube 524 and the hole saw (not shown) are inserted into a sheet of material, the microtube 524 pierces the material, thus pushing the material aside forming a strong friction fit between the material and an external surface of the microtube. Further, the serrated edge of the hole saw (not shown) cuts a circle of material around the microtube 524. The end result is a circle of material, such as thermoplastic, which may be the second thermoplastic portion 580, tightly secured on the microtube 542. Because the material is preferably elastic, when the second thermoplastic portion 580 is incorporated into the sleeve 552 and the sleeve 552 is installed on the hair 502, the sleeve 552 (which includes the second thermoplastic portion 580 formed according to this implementation) will revert to substantially its original, unexpanded size, and securely physically engage the hair 502.

A third option is to use a commercially available wire, such as wire 504, with a thermoplastic coating already formed on the wire 504. An example of such a wire with a coating is manufactured by Calmont Wire and Cable Inc. A portion of the thermoplastic coating is stripped from the wire 504, such that the wire 504 can be threaded through the microtube 542. A second portion of the thermoplastic coating is then cut to a desired length for the second thermoplastic portion 580 and transitioned onto the microtube 542 as described below. Then, the first thermoplastic portion 578, with the supplemental hairs 556 attached, is wrapped around the second thermoplastic portion 580, as described above. The end result is the sleeve 552 formed on the microtube 542 for installation.

Figure 7E:
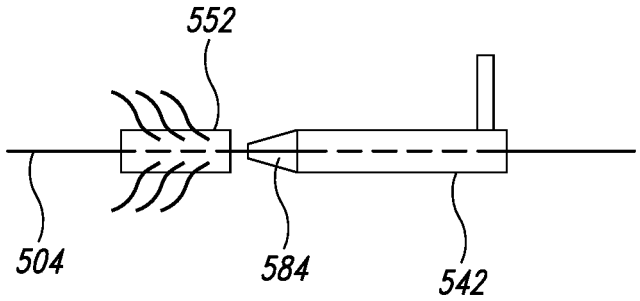
FIG. 7E is a side view of a process for sliding the sleeve of FIG. 7A onto the microtube in accordance with the present disclosure.
Figure 7F:
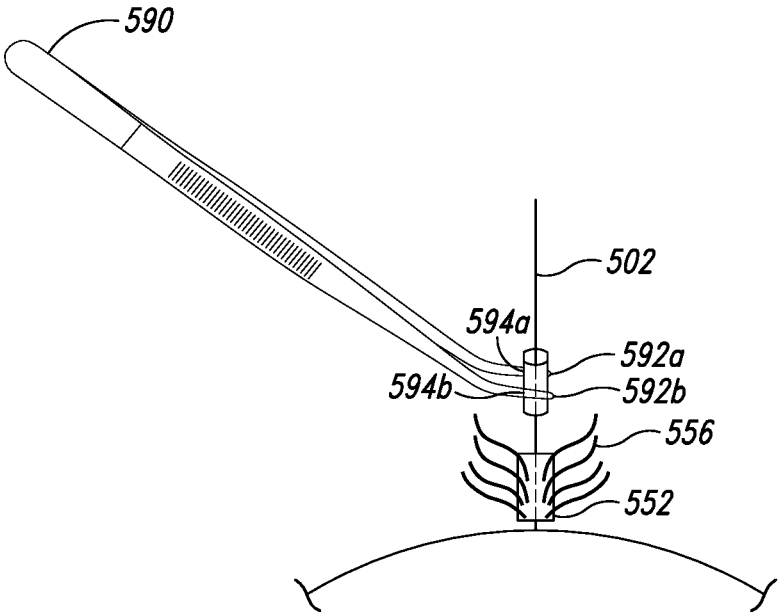
FIG. 7F is an illustration of an alternative implementation of a process for forming a roadblock according to the present disclosure in accordance with the present disclosure.

FIG. 7E is a side view of the process for sliding the sleeve 552, or the second thermoplastic portion 580, onto the microtube 542. As noted above, the wire 504 is inserted through the bore of the microtube 542. Then, a ramp 584 is formed, preferably of an adhesive, and the sleeve 552 is slide along the wire, along the ramp 584, and onto the microtube 542. The ramp 584 preferably provides a cone-shaped transition from the wire 504 up onto the microtube 542 to enable sliding of the sleeve 552 onto the microtube 542. The adhesive ramp 584 can then be removed with a solvent, such that the microtube 542 can be inserted into the funnel 524. Alternatively, the ramp 584 may be a separate component of plastic that is removed after sliding the sleeve 552 onto the tube 542.

Implementations of the present disclosure include installing the second thermoplastic portion 580, which may be a "naked" sleeve (i.e., having no supplemental hairs 556 attached thereto), onto the microtube and then installing the first thermoplastic portion 578 to the second thermoplastic portion 580 once the second thermoplastic portion 580 is on the tube 542 to create the sleeve 552, as discussed above.

An implementation of a method to increase hair density of existing hair will now be described with continuing reference to FIGS. 7A-7E. The method includes forming the sleeve 552 as described above, wherein the sleeve 552 has the external surface 554 with supplemental hairs 556 attached and extending therefrom. The method also includes forming the blocking element 558 as described herein. The sleeve 552 has an internal bore, or is preferably formed as a hollow cylinder with the internal longitudinal axial bore extending there through. The sleeve 552 is then slid onto the microtube 542 along with the blocking element 558, wherein the microtube 542 is another hollow cylinder with an internal bore, as described herein. Preferably, an exterior surface of the microtube 542 is similarly nanocoated (i.e. covered with a very thin layer of material, such as one with a thickness that is 10 millimeter (mm) or less, 1 mm or less, 1000 nanometers (nm) or less, 500 nm or less, 100 nm or less, or 50 nm or less) such as with Teflon®, so that the sleeve 552 and the blocking element 558 can easily slide along the tube 542, and any adhesives used in the installation process will not attach or adhere to the tube 542. In some implementations, the sliding includes using the ramp 584, which is formed of a removable adhesive, in which case, the adhesive would be removed with a solvent after the sleeve 552 is received on the microtube 542.

Then, the method continues by forming the funnel 524, which includes the portions 526, 528 removably coupled to define the inner bore, wherein the first diameter of the first portion 566 of the funnel portion 564 is greater than the second diameter of the second portion 568 of the funnel portion 564, and the second diameter of the second portion 568 is greater than an outermost diameter of the wire 504 and an outermost diameter of the microtube 542. In some implementations, the method includes coupling and locking the pliers 530 to the funnel 524, which includes coupling the first arm 532 of the pliers 530 to the external surface of the first portion 526, and the second arm 534 of the pliers 530 to the external surface of the second portion 528 of the funnel 524. Additionally or alternatively, in some implementations the coupling includes using an adhesive or other forms of fastening to couple the portions 526, 528 of the funnel 524 together.

The microtube 542 is then inserted into the funnel 524, or more specifically, the first end portion 544 of the microtube 542 is inserted into the tube portion 572 of the funnel 524. The nylon ring 576 secures the microtube 542 in place in the funnel 524, and may be inserted in the funnel 524 prior to being inserted the microtube 542, or may be inserted onto the microtube 542 before inserting into the funnel 524. The wire 504 is passed through the internal bore of the microtube 542 and the funnel 524 and laid to rest in the container 506, along with the existing hair 502. Then, adhesive is applied by the installer to the wire 504 and the hair 502 in the container. Alternatively, the container 506 may be prepared with adhesive already present, and the wire 504 and hair 502 are added after the adhesive. Preferably, the tool 512 is used to press the wire 504 and the hair 502 together.

Once the adhesive dries, the wire 504 and hair 502 combination is pulled back through the funnel 524 and the microtube 542 until the hair 502 extends beyond the second end portion 546 of the microtube 542. One of skill in the art will appreciate that while the adhesive dries between the wire 504 and the hair 502 in the container 512, the process of coupling a second wire (not shown) to a second hair (not shown) can be repeated, such that the installation process described herein can be simultaneously performed for multiple hairs at once.

Once the hair 502 extends beyond the microtube 542, the portions 526, 528 of the funnel 524 are separated by applying a force to the handles 536, 538 of the pliers 530. Then, the installer removes the nylon ring 576 with a tool, such as nail clippers. After removing the nylon ring 576, the installer uses the tool 560, which may be tweezers or forceps, to slide the sleeve 552 and the blocking element 558 off of the microtube 542 and onto the hair 502. In some implementations, the sliding includes sliding both of the microtube 542 and the blocking element 558 at the same time, while in other implementations, the sleeve 552 is slid first, followed by the blocking element 558 separately. In addition, the blocking element 558 may have adhesive within the blocking element 558 before it is positioned on the microtube 542, in which case the microtube 542 preferably includes a non-stick, thin coating, such as Teflon®, to prevent the adhesive from coupling the blocking element 558 to the microtube. In certain implementations, the blocking element is preferably formed of latex rubber, while in other implementations, the blocking element 558 is similarly formed of any one of a number of thermoplastics.

Once the sleeve 552 and the blocking element 558 are on the existing hair 502, the installer uses the tool 560 to crimp or close the blocking element 558, thus allowing the adhesive within the blocking element 558, which may be added before installation onto the microtube or after installation on the hair 502, to be sealed in a closed configuration, which traps the sleeve 552 against a scalp of the user. Alternatively, in implementations where the blocking element 558 comprises the strips of adhesive or has a circular cross-section along its length, crimping with the tool 560 is not required. Then, the adhesive coupling the wire 504 to the hair 502 is cut with a tool, which may be fingernail clippers or scissors for example, and the microtube 542 is slid off of the existing hair 502, at which point the installation process is complete. Preferably, the hair 502 and wire 504 are cut at a location where the hair overlaps with the 50 gauge wire, and more preferably, at a location proximate a distal end of the wire 504, such that no wire 504 or adhesive 510 remains on the hair 502.

Certain implementations further include adjusting the sleeve 552 to account for growth of the existing hair 502. After the hair 502 has grown out of the scalp of the user, the installer can use the tool 560 to slide the sleeve 552 down proximate the scalp and install another blocking element (not shown) to hold the sleeve 552 against the user's scalp in this new position. One of skill in the art will appreciate that the second blocking element (not shown) can be substantially similar or identical to any of the various implementations of the blocking element 558 described herein. Once installed, an outermost diameter or dimension of the blocking element 558 or blocking elements is greater than an internal diameter of the internal bore of the sleeve 552, such that the blocking element 558 prevents the sleeve 552 from sliding away from its preferred location adjacent or proximate to the scalp of the user.

In an aspect, the funnel 524 and the microtube 542 are not needed in order to advance the wire 504 and hair 502 combination through the system 500 (see FIG. 7A). Rather, because the hair 502 and the wire 504 are coupled together, the sleeve 552 and potentially the blocking element 558 can be positioned on the wire 504 and the wire 504 can be pulled through the sleeve 552 and the blocking element 558. Then, the wire 504 can be uncoupled from the hair 502, as above, and the blocking element secured to the hair 502.

Figure 8A:
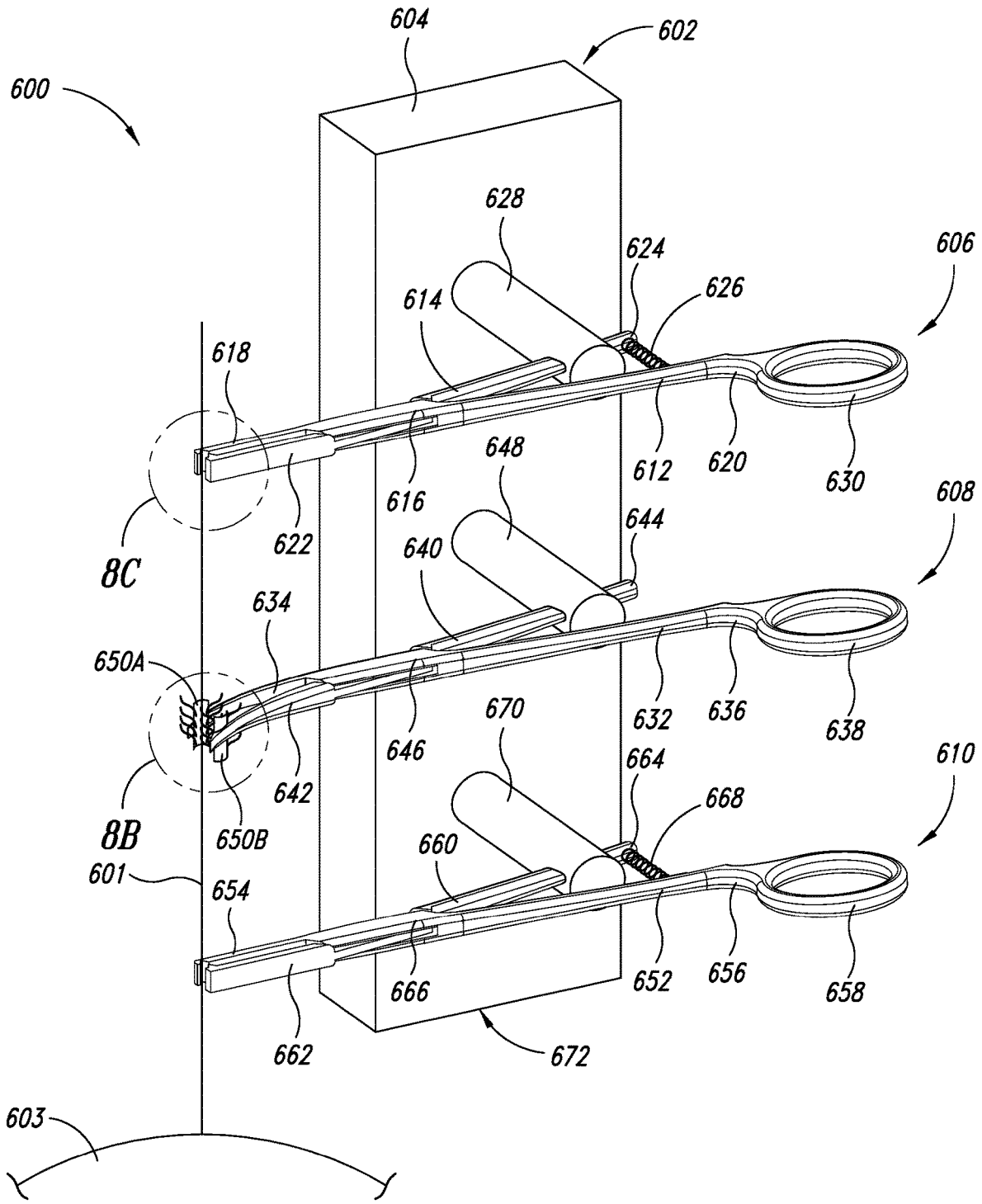
FIG. 8A is a perspective view of an alternative implementation of a supplemental hair installation system including a support block and three tools coupled to the support block to secure existing hair and attach a sleeve with supplemental hair extending therefrom in accordance with the present disclosure.

FIG. 8A illustrates an alternative implementation of a system 600 to increase hair density of existing hair 601, which may also be referred to as a host hair, extending from a scalp 603 of a user. The system 600 includes a support block 602, which may also be referred to as an installation block, a substrate, a support member, a support element, or simply, a support, a block, an element, or a body. The support block 602 is preferably comprised of plastic, although other materials, such as wood or metal, for example, may be used. The support block 602 includes a body 604 and three tools 606, 608, 610 coupled to the body 604 and extending therefrom. Each of the tools 606, 608, 610 are preferably a form of pliers or tweezers, although other similar structures with arms coupled together are expressly contemplated herein. For example, the first tool 606 includes a first arm 612 rotatably coupled to a second arm 614 by a joint 616. As such, the first tool 606 is manipulatable between an open configuration, as illustrated, and a closed configuration in which a distal end 618 of the first arm 612 is proximate, or preferably in abutting contact with a distal end 622 of the second arm 614.

The first 612 arm further includes a proximal end 620 opposite the distal end 618 and similarly, the second arm 614 includes a proximal end 624 opposite the distal end 622. In an aspect, the first tool 606 includes a spring 626 coupled between the first arm 612 and the second arm 614, preferably proximate the proximal ends 620, 624 of the arms 612, 614. The spring 626 is configured to exert a force to bias the distal end 618 of the first arm 612 towards the distal end 622 of the second arm 614. In other words, the spring 626 exerts a force that tends to force the first tool 606 from the open configuration to the closed configuration. As such, when the tool 606 is biased to the open configuration by an installer, the spring 626 is compressed, such that when the installer releases the force on the arms 612, 614, of the first tool 606, the spring 626 returns the first tool 606 to the closed configuration. In yet a further aspect, the first tool 606 may include a locking mechanism, such as when the first tool 606 is a pair of hemostat pliers in order to hold the first tool 606 in the closed configuration. Preferably, the first tool 606 is coupled to a post 628 extending from the body 604 of the support block 602. More specifically, in an aspect, the second arm 614 of the first tool 606 is fixedly coupled to the post 628 while in other aspects, the second arm 614 and the post 628 are a single, integral, unitary component. The first tool 606 further includes a handle 630 coupled to and extending from the proximal end 620 of the first arm 612. As such, the installer can manipulate the handle 630 to bias the first tool 606 between the open and closed configurations. The distal end 618 of the first arm 612 and the distal end 622 of the second arm 614 will be described in further detail with reference to FIG. 8C.

The second tool 608 can include many of the same features with the same function as described above with reference to the first tool 606. For example, the second tool 608 includes a first arm 632 with a distal end 634 opposite a proximal end 636 and a handle 638 coupled to and extending from the proximal end 636. The second tool 608 further includes a second arm 640 having a distal end 642 opposite a proximal end 644. The first arm 632 and the second arm 640 are rotatably coupled by a joint 646. The second arm 640 of the second tool 608 is coupled to a post 648 extending from the body 604 of the block 602. In an aspect, the second arm 640 is fixedly coupled to the post 648, while in other aspects, the second arm 640 and the post 648 are a single, integral, unitary component.

The second tool 608 differs from the first tool 606 in that the distal ends 634, 642 of the arms 632, 640 of the second tool 608 include recesses for removably receiving halves of a sleeve 650A, 650B for coupling to the existing hair 601, as described in further detail with reference to FIG. 8B. In addition, the second tool 608 may not include a spring, as illustrated, but rather, the installer applies the force to manipulate the second tool 608 between an open configuration shown in FIG. 8A and a closed configuration, in which the halves 650A, 650B of the sleeve are adhered to the existing hair 601. In other implementations, the second tool 608 includes a spring to assist with manipulating the second tool 608 between the open or closed configuration.

In an aspect, the third tool 610 is identical in structure and function to the first tool 606. However, briefly, an implementation of the third tool 610 includes a first arm 652 with a distal end 654 opposite a proximal end 656 and a handle 658 coupled to and extending from the proximal end 656. The third tool 610 further includes a second arm 660 having a distal end 662 opposite a proximal end 664. The first arm 652 and the second arm 660 are rotatably coupled by a joint 666. The third tool 610 further includes a spring 668 coupled between the first arm 652 and the second arm 660, which may be identical to spring 626 in structure and function. The second arm 660 is coupled to a post 670 extending from the body 604 of the block 602. In an aspect, the second arm 660 is fixedly coupled to the post 670, while in other aspects, the second arm 660 and the post 670 are a single, integral, unitary component. The posts 628, 648, 670 may also be referred to as first, second, and third posts, respectively, and are coupled to corresponding ones of the first, second, and third tools 606, 608, 610.

In operation, an installer aligns the support block 602 such that a base 672 thereof is proximate to, and preferably contacting the scalp 603 of the user. Then, the installer applies a force to handle 658 of the third tool 610 to manipulate the tool 610 to the open configuration. Once the tool 610 is open, the installer guides the existing hair 601 between the distal ends 654, 662 of the third tool 610, which is closest to the scalp 603. The installer then releases the force on the handle 658, wherein the spring 668 biases the distal ends 654, 662 of the third tool 610 towards each other, which temporarily secures the existing hair 601. The process is repeated to temporarily secure the hair 601 with the first tool 606. Because the first tool 606 and the third tool 610 are preferably fixed in place relative to the block 602, the hair 601 extending between the first tool 606 and the third tool 610 is in a known position in three-dimensional space relative to the block 602. As such, the second tool 608 can be used to accurately install the halves 650A, 650B of the sleeve to the existing hair 601 with adhesive, without requiring significant dexterity from the installer. Once the installer attaches the halves of the sleeves 650A, 650B to the hair 601, the installer releases the second tool 608, followed by the first tool 606, then the third tool 610. It is preferable, but not required, to secure the third tool 610 first and release the third tool 610 last because once the third tool 610 is secured, any force against the hair 601 away from the scalp will be distributed to the third tool 610, and as such, securing the third tool 610 first prevents pain to the user or removal of the existing hair 601 from the scalp 603.

Figure 8B:
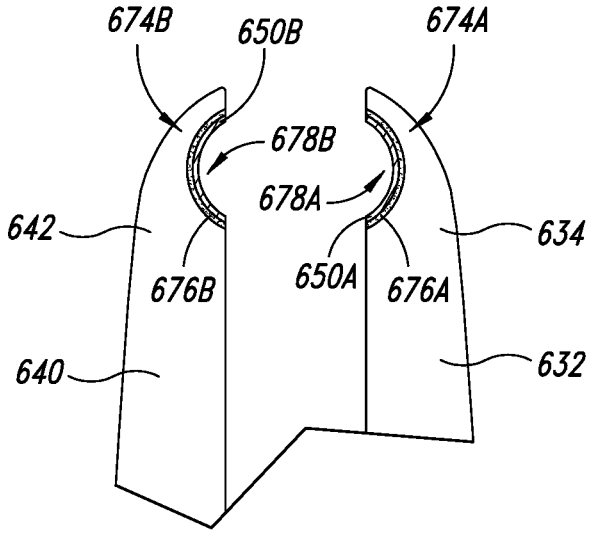
FIG. 8B is a top view of the sleeve and the end of one of the tools of FIG. 8A in accordance with the present disclosure.

FIG. 8B illustrates the distal ends 634, 642 of the first arm 632 and the second arm 640 of the second tool 608 in additional detail. A first sleeve half 650A is coupled to a recess 674A in the distal end 634 of the first arm 632 of the second tool 608 with a weak adhesive 676A between the first sleeve half 650A and the recess 674A. Similarly, a second sleeve half 650B is coupled to a recess 674B in the distal end 642 of the second arm 640 of the second tool 608 with a weak adhesive. Then, a strong adhesive is applied to an inner surface 678A of the first sleeve half 650A and an inner surface 678B of the second sleeve half 650B.

Once the installer secures the first and third tools 606, 610 (see FIG. 8A) as above, the installer can manipulate the second tool 608 such that the two halves 650A, 650B, are joined together with the existing hair 601 (see FIG. 8A) there between, with the halves 650A, 650B secured to the hair 601 (see FIG. 8A) by the strong adhesive. In other words, the two halves 650A, 650B form a circle around the existing hair 601 (see FIG. 8A), such that the hair 601 (see FIG. 8A) is at least partially received in each of the halves 650A, 650B. As used above, "strong" refers to an adhesive that is stronger than the "weak" adhesive. Preferably, the "strong" adhesive forms a bond between the hair 601 (see FIG. 8A) and the halves 650A, 650B of the sleeve that is at least twice as strong as the bond between the adhesive 676A, 676B, the halves of the sleeve 650A, 650B, and the recesses 674A, 674B, while in other aspects, the bond is less than twice as strong, or more than twice as strong, for example, three times, four times, or five or more times as strong. As such, each of the recesses 674A, 674B is configured to removably receive a respective sleeve half 650A, 650B. In other words, each of the recesses 674A, 674B are sized and shaped to receive a respective sleeve half 650A, 650B. Once the halves of the sleeve 650A, 650B are secured to the hair 601 (see FIG. 8A), the installer can manipulate the second tool 608 to release the halves of the sleeve 650A, 650B from the recesses 674A, 674B due to the weaker bond between the adhesive 676A, 676B, the recesses 674A, 674B, and the halves of the sleeve 650A, 650B relative to the bond between the stronger adhesive and the halves 650A, 650B and the hair 601 (see FIG. 8A).

Figure 8C:
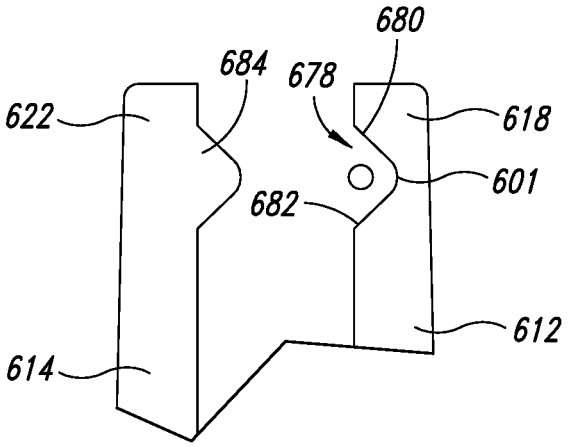
FIG. 8C is a top view of the ends of the outer tools of FIG. 8A for securing the existing hair in accordance with the present disclosure.

FIG. 8C illustrates the distal ends 618, 622 of the respective arms 612, 614 of the first tool 606 in additional detail. Although the distal ends 654, 662 of the arms 652, 660 of the third tool 610 are not illustrated in detail, it is to be understood that the distal ends 654, 662 of the arms 652, 660 of the third tool 610 are identical to the arrangement shown in FIG. 8C regarding the first tool 606 and thus these details will not be repeated for the third tool 610 in the interest of brevity and to avoid obscuring the implementations of the present disclosure. The distal end 618 of the first arm 612 of the first tool 606 includes a recess 678. Preferably, the recess 678 has surfaces 680, 682 that extend transverse to one another and are configured to receive and guide the existing hair 601. As illustrated, the surfaces 680, 682 form a 90 degree angle relative to each other, such that the recess 678 is triangular in shape. However, it is to be appreciated that the recess 678 can have any number of different shapes, for example, a half circle, a square, a rectangle, a trapezoid, an oval, or other geometric, curved, or rectilinear shapes. The distal end 622 of the second arm 614 has a wedge 684 extending therefrom with a size and a shape that corresponds to the recess 678. In the illustrated implementation, the wedge 684 is generally triangular in nature, similar to the recess 678. Further, it is to be understood that the vertex of the wedge 684 is preferably rounded and potentially even semi-circular in shape and the vertex of the recess 678 is preferably rounded or semi-circular in shape, such that securing the hair 601 between the wedge 685 and the recess 678 will not sever or damage the hair 601.

As such, the recess 678 is configured to receive the wedge 684 and the wedge 684 is configured to be inserted into the recess 678. In operation, an installer guides the existing or host hair 601 into the recess 678, aided, as needed, by the surfaces 680, 682. In the illustrated implementation, the surfaces 680, 682 are flat and planar and at an angle to each other with a vertex distal to the wedge 684, such that the hair 601 is guided towards the vertex between the surfaces 680, 682. Once the hair 601 is received in the recess 678, the installer releases the force on the first tool 606 (see FIG. 8A) such that the second arm 614 is brought towards the first arm 612 by the spring 626 (see FIG. 8A), and the wedge 684 is received in the recess 678 such that the hair 601 is trapped between the wedge 684 and the recess 678 due to the force of the spring 626 (see FIG. 8A).

In an aspect, the halves 650A, 650B of the sleeve are formed from a thermoplastic layer on a 42 gauge wire (e.g. the thermoplastic layer is hollow with the wire extending there through), such as of the type manufactured by Calmont Wire and Cable Inc. The diameter of the wire is about 0.063 mm (e.g. between 0.05 and 0.07 mm) and with the thermoplastic layer, an overall outside diameter of the combination is about 0.46 mm (e.g. between 0.4 and 0.5 mm). This translates to a wall thickness of the layer being about 0.2 mm (e.g. between 0.15 mm and 0.25 mm). An average diameter of an existing hair, such as existing hair 601 (see FIG. 8A) is 0.1 mm. Preferably, the two halves 650A, 650B are formed by cutting a ¼" length of the thermoplastic layer in half to form the two halves 650A, 650B, each of which have a shape similar to half of a hollow cylinder. Supplemental hairs can be adhered to the thermoplastic as described herein, either before or after cutting the thermoplastic.

In an alternative aspect, a mold can be used to create the two halves 650A, 650B, with supplemental hairs adhered after or during formation. The mold allows for creation of the halves 650A, 650B with a wall thickness of about 0.1 mm (e.g. between 0.05 mm and 0.15 mm). The overall size or diameter remains the same, such that the internal recess is twice the size due to the reduction wall thickness. This creates more space for receiving the existing hair 601 (see FIG. 8A) in order to further increase efficiency and accuracy of the installation process while reducing the amount of dexterity utilized by the installer.

It is to be further appreciated that each of the tools 606, 608, 610 (see FIG. 8A) described herein can be used independently of the support block 602 (see FIG. 8A). In an aspect, only the second tool 608 is used to install the halves 650A, 650B without using the support block 602 (see FIG. 8A) or the additional tools 606, 610 (see FIG. 8A). Further, the two halves 650A, 650B of the sleeve can be formed as a single piece of thermoplastic cut along its length. In such an aspect, the sleeve with the aperture is attached to the second tool 608 (see FIG. 8A), wherein the hair in the fixed position between the first and third tools 606, 610 (see FIG. 8A) enables efficient and accurate installation of the sleeve, as the second tool 608 (see FIG. 8B) is configured to align the aperture of the single piece thermoplastic sleeve with supplemental hairs extending therefrom with the existing hair, such that when the installer manipulates the second tool 608 to the closed configuration, the existing hair is inserted through the aperture and coupled to the hair with adhesive. In other words, adhesive is used to couple the sleeve with the aperture to the hair as well as to close the aperture, such that the sleeve with the aperture encircles at a least a portion of the existing hair.

In an aspect of implementations where a single piece sleeve is used and cut along its length, the installer can secure the existing hair 601 in the third tool 610, position the existing hair 601 in the sleeve through the aperture, and then secure the hair 601 to the first tool 606 (see FIG. 8A). Then, the sleeve can be closed onto the host hair via the second tool 608 (see FIG. 8A), or with an independent tool, such as an external set of tweezers, pliers, or forceps. In yet a further aspect, the first and third tools 606, 610 (see FIG. 8A) are not used, but rather, the sleeve is positioned on the hair 601 by inserting the hair 601 through the aperture of the single piece sleeve with adhesive already applied, and then a single tool is used to close the sleeve, thus securing it to the hair 601 and closing the aperture.

Figure 9:
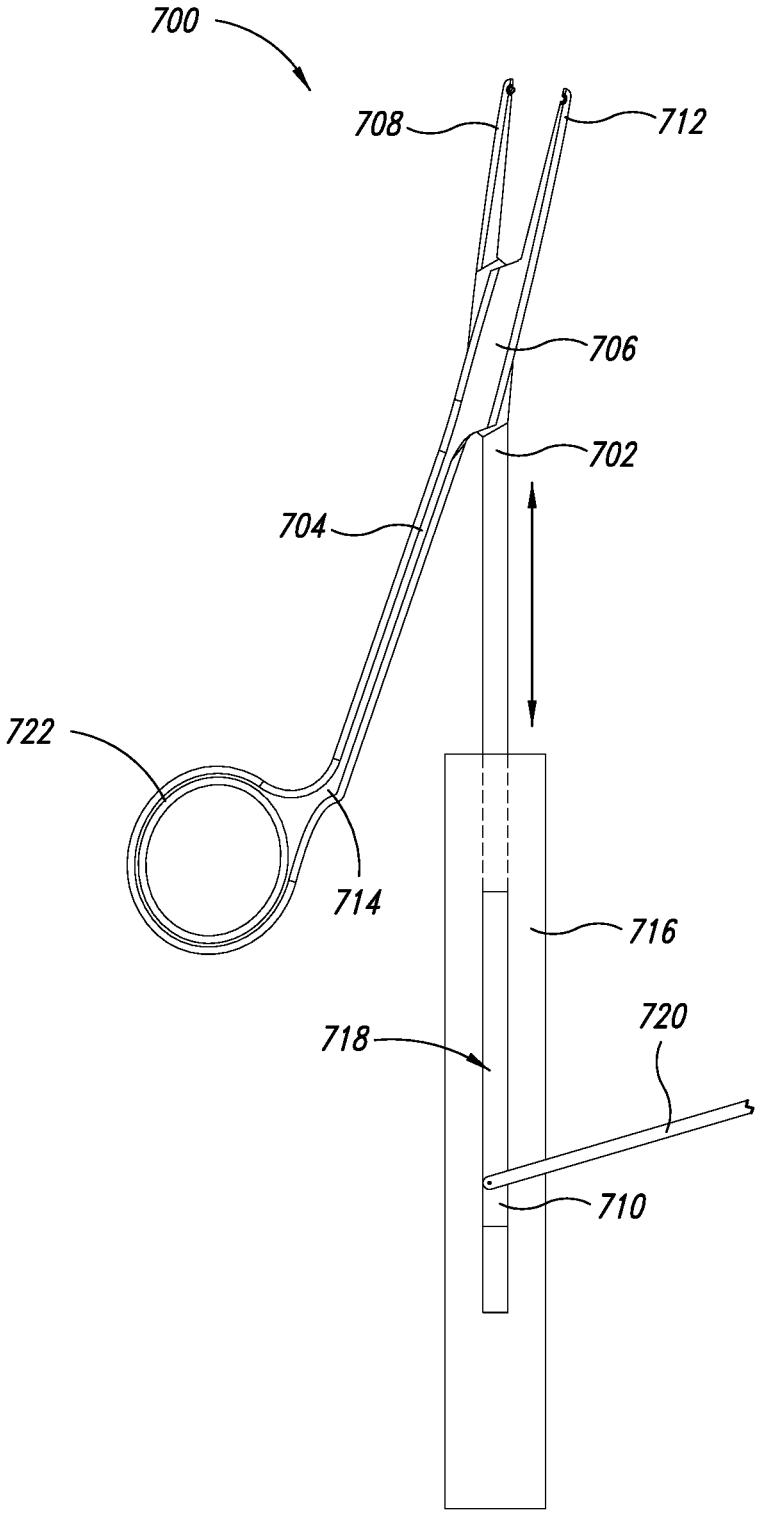
FIG. 9 is a perspective view of an alternative implementation of a supplemental hair installation system including a tool that slides along a tube to secure a sleeve on an existing hair that is in a fixed position in accordance with the present disclosure.

FIG. 9 illustrates an alternative implementation of a tool 700 for increasing density of existing hair. The tool 700 includes a first arm 702 rotatably coupled to a second arm 704 at a hinge 706. The first arm 702 includes a distal end 708 opposite a proximal end 710 and the second arm 704 includes a distal end 712 opposite a proximal end 714. It is to be appreciated that in an aspect, the distal ends 708, 712 of the arms 702, 704, respectively, are identical to the distal ends 634, 642 described above with reference to FIG. 8B. As such, the tool 700 can perform a similar function as the second tool 608 (see FIG. 8A), namely installing halves of a sleeve with supplemental hairs extending therefrom onto an existing or host hair. The proximal end 714 of the second arm 704 has a handle 722 integrated therewith. The proximal end 710 of the first arm 702 is received in a support tube or post 716. In an aspect, the tube 716 replaces post 648 (see FIG. 8A).

The tube 716 includes an internal bore which receives the first arm 702 of the tool 700. In other words, the tube 716 is configured to receive the first arm 702 of the tool 700. Further, the tube 716 has an aperture 718 extending through the tube 716. A handle or lever 720 is coupled to the first arm 702 proximate the proximal end 710 of the first arm 702 through the aperture 718. Preferably, the lever 720 is fixedly coupled to the first arm 702, such that the lever 720 does not rotate or translate relative to the first arm 702. As such, an installer can manipulate the handle 722 to manipulate the second arm 704 and manipulate the lever 720 to manipulate the first arm 702 during installation of the sleeve with supplemental hairs. When the installer manipulates the lever 720, the first arm 702 translates along the internal bore of the tube 716 to move the distal end 708 of the first arm 702 towards the distal end 712 of the second arm 704. Because the aperture 718 does not extend along an entire length or height of the tube 716, the coupling between the lever 720 and the tube 716 will prevent the first arm 702 from translating out of the tube 716.

As such, the tool 700 and the tube 716 can be used as an alternative to the second tool 608 and the post 648 in the system 600 of FIG. 8A. In other implementations, the tool 700 and the tube 716 can be considered an independent system for increasing density of existing hair, wherein the tube 716 can be positioned proximate a scalp of a user, and the tool 700 can be manipulated as above to install a sleeve with supplemental hairs extending therefrom to the existing hair.

Figure 10:
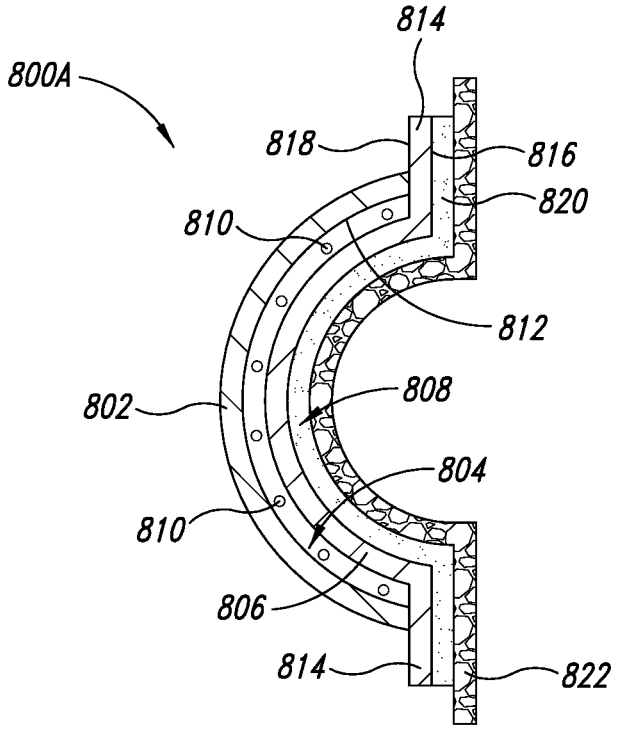
FIG. 10 is a cross-sectional view of an alternative implementation of a supplemental hair installation system including supplemental hairs coupled between layers of material and an adhesive on an inner surface of one of the layers of material with a cover strip on the adhesive in accordance with the present disclosure.
Figure 11B:
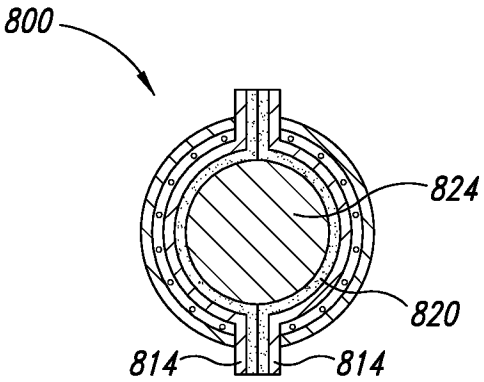
FIG. 11B is a top view of the system of FIG. 10 installed on an existing hair in accordance with the present disclosure.
Figure 11A:
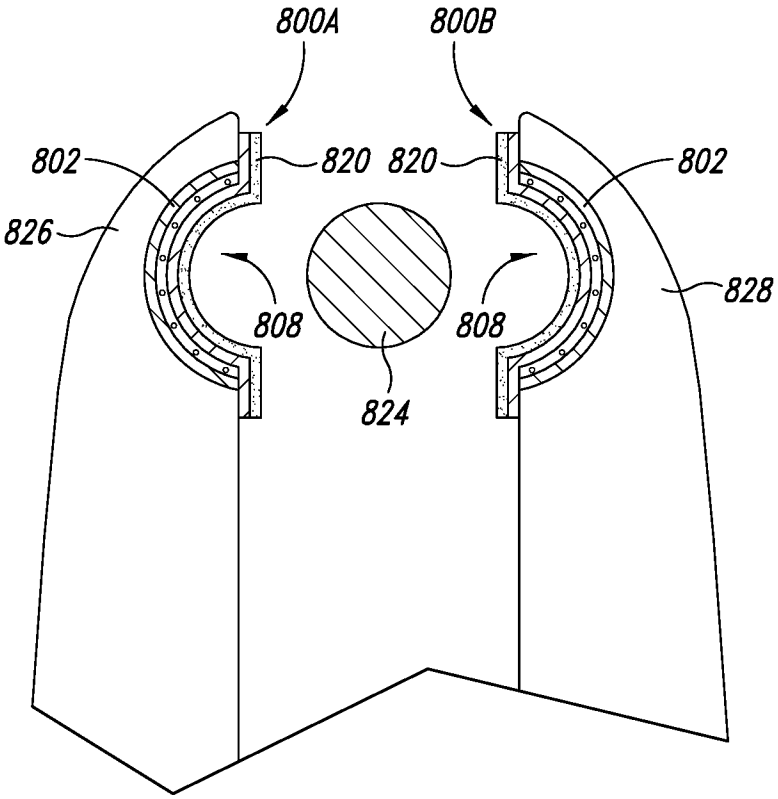
FIG. 11A is a top view of the system of FIG. 10 coupled to a tool for installing the system on an existing hair in accordance with the present disclosure.

FIGS. 10 and 11A-B are cross sectional views of an implementation of a sleeve 800. FIG. 10 illustrates a first half 800A of the sleeve 800. The first half 800A includes a first layer 802. The first layer 802 includes a recess 804 along a length of the first layer 802. The first layer 804 may be thermoplastic, for example, although other materials, such as other plastics and polymers, are contemplated herein. The recess 804 is configured to receive a second layer 806, which may also be thermoplastic. In other words, the recess 804 and the first layer 802 have a size and a shape to at least partially receive the second layer 806. In the illustrated implementation, the second layer 806 is at least partially received in the recess 804 of the first layer 802. The second layer 806 also defines a recess 808. In an aspect, a radius of curvature of the recess 804 and the recess 808 are identical, while in other aspects, the radii of curvature of the recesses 804, 808 are within 5% of each other. In an aspect, the second layer 806 is coupled to the first layer 802 with an adhesive while in other aspects, the second layer 806 is coupled to the first layer 802 by melting the first layer 802 and the second layer 806 together.

Between the first layer 802 and the second layer 806 are supplemental hairs 810. In certain aspects, adhesive is applied to a first surface 812 of the first layer 802, such that when the second layer 806 is received in the recess 804, the supplemental hairs 810 are trapped between the layers 802, 806 and held in place by the adhesive. In other aspects where the layers 802, 806 are melted together, the supplemental hairs 810 are coupled to the melted combination of the two layers 802, 806, or in other words, are internal to the resulting combination and are fused between the layers 802, 806. It is to be further appreciated that the supplemental hairs 810 extend outward from the first half 800A of the sleeve 800 (e.g. extend in a direction into or out of the page in the orientation shown in FIG. 10, as applicable), as described herein with other implementations of sleeves. As described in more detail with reference to FIGS. 11A-11B, the recess 808 of the second layer 806 is configured to receive and be adhered to an existing hair.

The second layer 806 further includes at least one flange 814, which preferably extends at least to an outermost edge or surface of the first layer 802. In the illustrated implementation, there are two opposing flanges 814, although it is to be appreciated that the second layer 806 could include only one flange 814. Each of the flanges 814 have a flat and planar major surface 816. As shown in FIG. 10, the first layer 802 is coupled to the flanges 814 of the second layer 806 on a flat and planar surface 818 opposite the major surface 816. In an aspect, the first half 800A of the sleeve 800 can be manufactured to be ready to couple to a tool and applied to an existing hair. For example, in an aspect, an adhesive 820 is applied to the major surfaces 816 of the flanges 814 and to the surface defining the recess 808. In other words, an adhesive layer 820 is applied to an outer surface of the second layer 806. Then, a cover strip 822 is adhered to the adhesive 820. Preferably, the cover strip 822 extends beyond an outermost edge of the flanges 814, as illustrated, to enable removal of the cover strip 822. In other aspects, the edges of the cover strip 822 are flush with an outermost edge of the flanges 814, but the cover strip extends beyond an outermost edge of the first and second layers 802, 806 at ends of the first and second layers 802, 806 (e.g. in a direction in and out of the page in the orientation shown) again to facilitate removal of the cover strip 822.

Preferably, the adhesive 820 remains in liquid or gel form until exposed to air, such that the cover strip 822 prevents curing of the adhesive until the cover strip 822 is removed and the first half 800A of the sleeve 800 is adhered to an existing hair. In other aspects, the cover strip 822 has a covering or coating on the surface facing and in contact with the adhesive 820, such that the adhesive 820 does not form a strong bond with the cover strip 822, but will form a strong bond with the existing hair. In aspects where the adhesive 820 is provided before installation, the first half 800A of the sleeve 800 can be sold as a ready to apply unit. In other aspects where the cover strip 822 and the adhesive 820 are not included, the first half 800A of the sleeve 800 includes the first layer 802 coupled to the second layer 806 with supplemental hairs 810 there between, and the installer provides the adhesive 820 to the second layer 806 before installation.

FIGS. 11A and 11B illustrate installation of the sleeve 800 onto an existing or host hair 824. As shown in FIG. 11A, the sleeve 800 consists of a first half 800A and a second half 800B. The first half 800A is described above with reference to FIG. 10, but it is to be appreciated that the second half 800B of the sleeve 800 can be identical in all respects to the first half 800A described herein. In operation, an installer takes the pre-formed halves 800A, 800B of the sleeve 800 and removably couples the halves 800A, 800B to ends 826, 828 of a tool, which may be identical to second tool 608 (see FIG. 8A-8B). In other words, the ends 826, 828 of the tool are configured to receive the respective halves 800A, 800B of the sleeve 800. In an aspect, the halves 800A, 800B of the sleeve 800 are coupled to the ends 826, 828 of the tool by a friction fit, while in other aspects, a light adhesive is used between the first layer 802 of each of the halves 800A, 800B of the sleeve 800 and the ends 826, 828 of the tool. Then, the ends 826, 828 of the tool are positioned such that the existing hair 824 is aligned with the second recess 808 of each of the halves 800A, 800B of the sleeve 800. In some aspects, the adhesive 820 will be pre-formed on each of the halves 800A, 800B, while in other aspects, the installer applies the adhesive 820 to the second layers 806 of the halves 800A, 800B of the sleeve 800.

The installer then manipulates the ends 826, 828 of the tool to close the halves 800A, 800B of the sleeve 800 around the existing hair 824, as shown in FIG. 11B. In other words, when the halves 800A, 800B are adhered to each other, they form the complete sleeve 800, which forms a circle around at least a portion of the hair 824. The sleeve 800 includes the adhesive 820 adhered to the hair 824, as well as the flanges 814 of each of the halves 800A, 800B adhered to each other with the adhesive 820. Preferably, the adhesive 820 is stronger than any adhesive used to couple the halves 800A, 800B to the tool in FIG. 11A, such that the halves 800A, 800B can be easily removed from the tool and coupled to the hair 824. The above described process is particular advantageous in situations where the position of the hair 824 is known, such as that described above with reference to FIG. 8A. In other words, once the hair 824 position is known and fixed, the sleeve 800 can be applied in an efficient process without significant dexterity on the part of the installer because the hair 824 is preferably aligned with the halves 800A, 800B through use of the first and third tools 606, 610 (see FIG. 8A). It is to be appreciated that the sleeve 800 and the associated installation procedure can be utilized with other implementations described herein, such as the system 600 described with reference to FIG. 8A.

In the above description of FIGS. 10-11B, it is to be understood that each of the layers 802, 806 for each half 800A, 800B of the sleeve can be formed by molding thermoplastic. The second recess 808 of each of the halves 800A, 800B preferably has a diameter that is at least 0.05 mm, such that when the sleeve 800 is formed, the recesses 808 form a circle around the existing hair 824, which has a diameter of about 0.1 mm. A thickness of the combined first and second layers 802, 806 is preferably about 0.23 mm, such that the overall wall thickness of the combined layers in the sleeve is about 0.46 mm, as above.

Figure 12A:
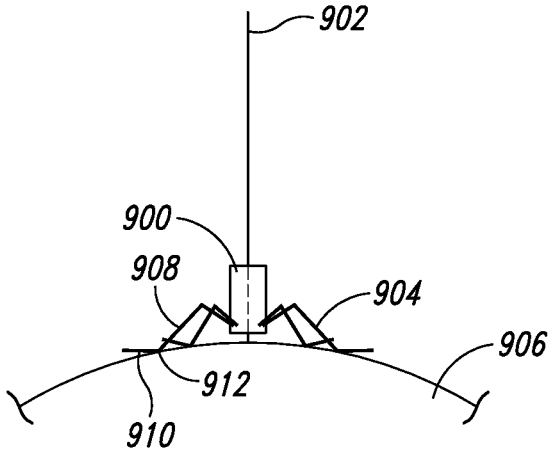
FIG. 12A is a side view of an alternative implementation of a supplemental hair installation system with a sleeve with supplemental hairs having pre-formed bends in accordance with the present disclosure.
Figure 12B:
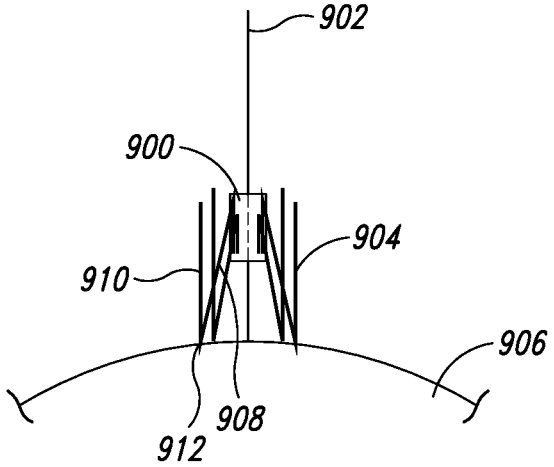
FIG. 12B is a side view of the system of FIG. 12A illustrating the supplemental hairs covering the scalp after the sleeve moves away from the scalp due to growth of the existing hair in accordance with the present disclosure.

FIGS. 12A-12B illustrate an alternative implementation of a sleeve 900 for increasing density of existing hair 902. The sleeve may be similar to any of the implementations described herein, including sleeve 800 described above with reference to FIGS. 10-11B. The sleeve 900 includes supplemental hairs 904 extending therefrom, which may be attached to the sleeve 900 as described herein. FIG. 12A illustrates the sleeve 900 proximate a scalp 906 of a user. In other words, FIG. 12A illustrates the position of the sleeve 900 shortly after installation, before the hair 902 grows away from the scalp 906. Each of the hairs 904 includes a first portion 908 connected to a second portion 910. In an aspect, the first portion 908 is proximate the sleeve 900 and the second portion 910 is distal to the sleeve 900 relative to the first portion 908. The first portion 908 and the second portion 910 are separated by a pre-formed angle or bend 912 in the supplemental hair 904.

When the sleeve 900 is proximate the scalp 906 after installation, as in FIG. 12A, each of the portions 908, 910 of the supplemental hairs 904 are proximate the scalp 906, as the scalp pushes the hairs 904 away from the sleeve 900. Due to the bend 912 in the hairs 904, the hairs 904 extend away from the scalp after flattening near the scalp 906. Then, as the existing hair 902 grows from the scalp 906, the supplemental hairs 904 regain their shape, such that the first portion 908 of the supplemental hairs 904 move closer to the sleeve 900 relative to the orientation in FIG. 12A and the bend 912 becomes acute, or at least less than the bend 912 in FIG. 12A. As such, in FIG. 12B, the first portion 908 of each supplemental hair 908 extends towards the scalp 906 to provide coverage of the scalp 906 proximate the sleeve 900, while the bend 912 causes the second portion 910 to extend away from the scalp 906 to increase the density of the existing hair 902. As such, the pre-bent supplemental hairs 904 can increase the amount of time between user appointments for adjustment of the sleeve 900.

Figure 13A:
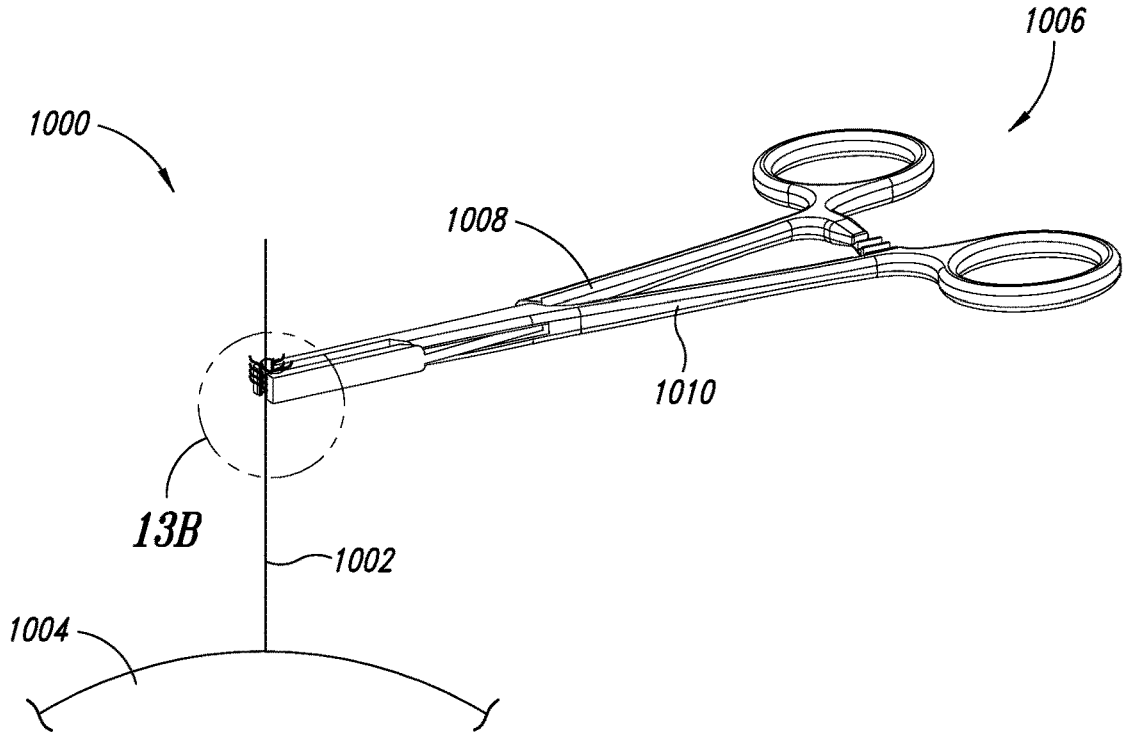
FIG. 13A is an axonometric view of an alternative implementation of a supplemental hair installation system including a tool for installing a sleeve on an existing strand of hair in accordance with the present disclosure.
Figure 13B:
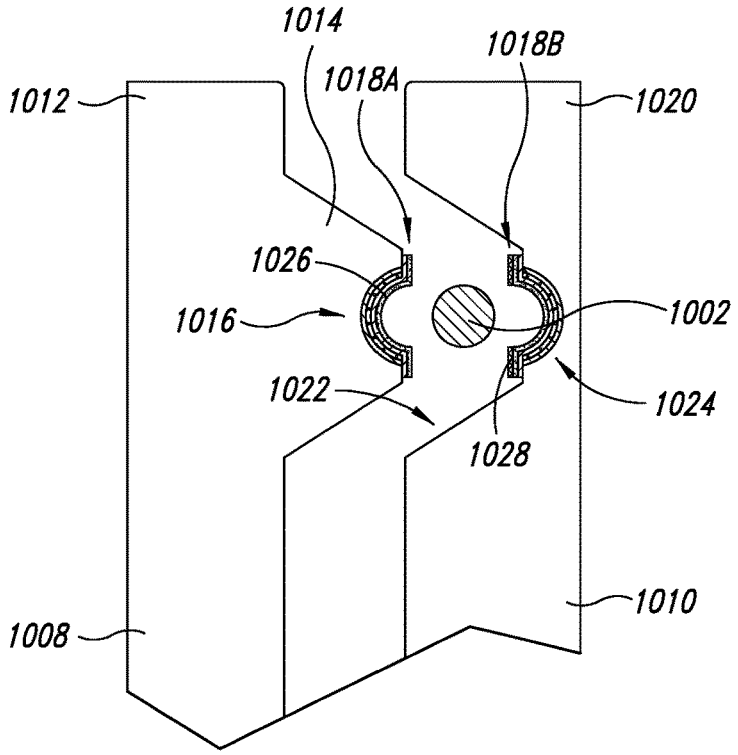
FIG. 13B is a top view of the implementation of FIG. 13A.

FIGS. 13A-B illustrate an alternative implementation of a system or device 1000 for adding supplemental hair to an existing strand of hair 1002 extending from a user's scalp 1004. The system 1000 includes a tool 1006. Although the tool 1006 is illustrated as a pair of pliers having handles, it is to be appreciated that the tool 1006 can also be similar to a pair of tweezers, or any other structure with arms that are movable in relation to each other. The tool 1006 includes a first arm 1008 coupled, or in the illustrated implementation rotatably coupled, to a second arm 1010. An end 1012 of the first arm 1008 includes a wedge 1014 extending from the first arm 1008. The first arm 1008, and more specifically, the wedge 1014 has a recess 1016 sized and shaped to receive a first sleeve half 1018A. The first sleeve half 1018A may be identical to the first sleeve half 800A described with reference to FIG. 11A. As such, the first sleeve half 1018A preferably includes two layers of thermoplastic coupled together with a plurality of supplemental hairs coupled there between and extending therefrom. The first sleeve half 1018A, and more specifically the second layer, is sized and shaped to at least partially receive the strand of existing hair 1002 and may include flanges, as described herein.

An end 1020 of the second arm 1010 includes a groove 1022 sized and shape to receive the wedge 1014 when the first arm 1008 is biased towards the second arm 1010. The groove 1022 also includes a recess 1024 sized and shape to receive a second sleeve half 1018B, which may be identical to the first sleeve half 1018A and the second sleeve half 800B (see FIG. 11A) described herein. As such, it is to be appreciated that the second sleeve half 10186 includes multiple layers of thermoplastic with a plurality of supplemental hairs coupled to at least one of the layers or between the layers and extending therefrom. In an implementation, the ends 1012, 1020 of the first and second arms 1008, 1010 are wider than a length of the sleeve halves 1018A, 1018B. A channel can be formed extending from the recess 1024 in the second arm 110 between an outermost edge of the recess 1024 and an outermost edge of the end 1020 of the second arm 1010 in both directions relative to the recess 1024. In other words, an elevational view of the second arm 1010 (e.g. an elevational view showing the recess 1024) would include, in order, an outermost edge of the second arm 1010, a portion of the channel extending into the second arm 1010 and connected to the groove 1022 and the recess 1024, then a second portion of the channel on the other side of the groove 1022 and the recess 1024 extending to an opposite outermost edge of the second arm 1010. Preferably, each of the channel portions extends further into the second arm 1010 than the groove 1022 and the recess 1024. The channel portions help guide the strand of existing hair 1002 into the second sleeve half 10186.

In yet a further alternative implementation, the sleeve halves 1018A, 10186 are pre-formed on a plate that is slid into place in the respective recesses 1016, 1024 in order to aid in orienting the sleeve halves 1018A, 1018B in the correct position. In yet a further implementation, the ends 1012, 1020 of the arms 1008, 1010, are removably coupled to the tool 1006. In such an implementation, the sleeve halves 1018A, 1018B are pre-formed in the recesses 1016, 1024, and the ends 1012, 1020 are coupled to the tool 1006 for installation, as otherwise described herein. This is an alternative implementation that ensures that the sleeve halves 1018A, 1018B are in the correct orientation for installation. In operation, the halves of the sleeve 1018A, 1018B are coupled to the recesses 1016, 1024 of the first arm 1008 and the second arm 1010, respectively, such as with a weak adhesive or by a friction fit. Then, the tool 1006 is positioned such that the strand of existing hair 1002 is aligned between the halves of the sleeve 1018A, 1018B, as shown in FIG. 13B. Preferably, the strand of hair 1002 is at least partially received in the second sleeve half 1018B. The sloped sides of the groove 1022 assist with guiding the strand of existing hair 1002 towards the second sleeve half 1018B. Then, an installer manipulates the tool 1006 to bias the first arm 1008 towards the second arm 1010 to couple the halves of the sleeve 1018A, 1018B together to from the sleeve, as described herein. The strand of existing hair 1002 is received in each of the halves, such that the sleeve forms a circle around the strand of existing hair 1002. In aspect, each of the halves of the sleeves 1018A, 1018B include flanges which have flat and planar surfaces and are configured to be coupled to each other to form the sleeve with the strand of existing hair 1002 trapped between the flanges and the halves of the sleeve 1018A, 1018B. As such, the tool 1006 is configured to couple the first sleeve half 1018A to the second sleeve half 1018B with the stand of existing hair 1002 there between. In yet further implementations, the tool 1006 may replace the second tool 608 in the system 600 shown in FIG. 8A, in which case, the tool 1006 can be coupled to post 648 and support block 602 (see FIG. 8A).

In an implementation, the halves of the sleeve 1018A, 1018B have adhesive 1026 preformed on a surface facing the existing strand of hair 1002. This adhesive can be covered by a single cover strip as described above. However, in other implementations, the adhesive 1026 can be covered by a cover strip with two separate pieces removably coupled to the adhesive 1026. The first piece of the cover strip is removably adhered to cover the recess in each sleeve half 1018A, 1018B that faces the existing hair 1002, as described herein. A second piece or pieces of the cover strip 1028 cover the flanges. As such, during installation, the first piece of cover strip can be removed from the portion of each of the halves 1018A, 1018B that receives the strand of hair 1002. Then, the second pieces of cover strip 1028 can be removed from the flanges of the first sleeve half 1018A only, such that the first sleeve half 1018A is ready to install.

The second pieces of cover strip 1028 on the flanges of the second sleeve half 1018B preferably remain in place so that the existing hair 1002 is not adhered to the adhesive 1026 as it is guided into the second sleeve half 1018B by the groove 1022. Rather, after the strand of existing hair 1002 is visually confirmed to be received in the second sleeve half 1018B, then the second piece of the cover strip 1028 is removed from each of the flanges of the second sleeve half 1018B, and installation continues, as above. In an aspect, the cover strips described herein having tabs extending beyond an outermost surface of the halves of the sleeve, such as halves 1018A, 1018B, to make it easier for the installer to remove the cover strips. As such, it is to be appreciated that the cover strips are preferably removably coupled to the respective halves of the sleeve 1018A, 1018B.

In an implementation, an alternative system combines features of the various systems and methods described herein, such as those described with reference to FIGS. 7A-7F and FIGS. 13A-B. For example, an implementation of a system and a method may include the strand of existing hair 502 coupled to the wire 504, either with or without the container 506 (see FIG. 7A). The wire 504 pulls the hair 502 through the funnel 524 and the microtube 542 removably coupled to the funnel 524 (see FIG. 7A). The sleeve 552 with supplemental hairs 556 extending therefrom is on the microtube 542, such that once the strand of existing hair 502 is pulled through the microtube 542, the sleeve 552 is slid off the microtube 542 and onto the strand of existing hair 504. Then, the wire 504, the funnel 524, and the microtube 542 are removed, as described with reference to FIG. 7A.

Figure 7G:
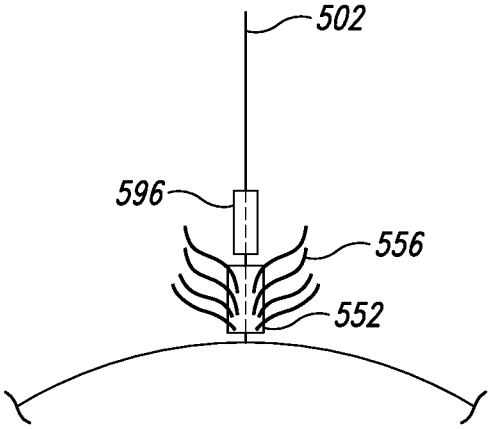
FIG. 7G is a side view of the road block of FIG. 7F in an installed configuration in accordance with the present disclosure.

Then, the tool 1006 illustrated in FIGS. 13A-B can be used instead of the tool 590 in FIG. 7F to install the two strips 594*a*, 594*b* that form the blocking element 596 (see FIG. 7G) on the hair 502. In other words, the tool 1006 has recesses configured to receive two halves of a blocking element and couple them together with adhesive provided by the installer, wherein the blocking element may be similar to blocking element 596 in FIG. 7G. In such implementation, adhesive is not applied to the sleeve 552. Rather, the sleeve 552 rests on the hair and is held in place by the blocking element installed by the tool 1006. Over time, as the strand of existing hair 502 grows away from the scalp of a user, the sleeve can be slid down closer to the scalp and a new blocking element can be installed using the tool 1006. The previous blocking element is allowed to naturally fall off as the adhesive degrades. If the sleeve 552 is to be removed, the blocking element can be removed with a solvent, for example, and the sleeve 552 slid off the hair 502 (see FIG. 7A).

The various implementations described above can be combined to provide further implementations. In addition, while the present disclosure has been described in the context of human hair, it will be appreciated that it can be utilized on any hair or flexible filament that has the characteristics of hair. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A system for adding supplemental hair to existing hair, comprising:
- a strand of material;
- a first sleeve half that includes:
  - at least one layer sized and shaped to at least partially receive the strand of material; and
  - a plurality of first supplement hairs coupled to and extending from the at least one layer;
- a second sleeve half that includes:
  - at least one layer sized and shaped to at least partially receive the strand of material; and
  - a plurality of second supplemental hairs coupled to and extending from the second sleeve half; and
- a tool, the tool including:
  - a first arm having a recess sized and shaped to receive the first sleeve half; and
  - a second arm coupled to the first arm, the second arm having a recess sized and shaped to receive the second sleeve half, wherein the first arm and the second arm of the tool are configured to press the first sleeve half to the second sleeve half together and couple the first sleeve half to the second sleeve half with an adhesive to form a sleeve around the strand of material.

2. The system of claim 1 wherein the strand of material is a wire.

3. The system of claim 1 wherein the strand of material is a strand of hair.

4. The system of claim 1 wherein the strand of material is structured to be coupled to the existing hair and the sleeve has an internal bore with a diameter sized and shaped to slide from the strand of material to the strand of existing hair.

5. The system of claim 4, further comprising:
- a blocking element having an outermost diameter greater than the diameter of the internal bore of the sleeve and being configurable between an installed configuration and an uninstalled configuration, wherein in the installed configuration, the blocking element is coupled to the existing hair.

6. The system of claim 4, further comprising:
- a container sized and shaped to receive the strand of material and the existing hair to facilitate coupling the strand of material to the existing hair.

7. A method of increasing hair density of existing hair that includes a strand of existing hair, the method comprising:
- coupling a plurality of first supplemental hairs to a first sleeve half with a first arm of a tool;
- coupling a plurality of second supplemental hairs to a second sleeve half with a second arm of the tool;
- forming a sleeve around a strand of material with the tool, including coupling the first sleeve half to the second sleeve half to each other with an adhesive around the strand of material with the tool;
- coupling the strand of material to the strand of existing hair;
- sliding the sleeve from the strand of material to the strand of existing hair; and
- applying a blocking element to the strand of existing hair.

8. The method of claim 7 wherein the coupling the plurality of first supplemental hairs includes forming the first sleeve half via a recess in the first arm of the tool to have a size and a shape of the first sleeve half.

9. The method of claim 8 wherein the coupling the plurality of second supplemental hairs includes forming the second sleeve half via a recess in the second arm of the tool with a size and a shape of the second sleeve half.

10. The method of claim 7, further comprising, after sliding the sleeve:

cutting the strand of material and the strand of existing hair at a junction between the strand of material and the strand of existing hair.

11. The method of claim 7 wherein the applying the blocking element to the strand of existing hair includes forming the blocking element to have an outermost dimension greater than a dimension of an inner bore of the sleeve to prevent the sleeve from sliding off the strand of existing hair.

* * * * *